US005988061A

United States Patent [19]

Kagawa

[11] Patent Number: 5,988,061

[45] Date of Patent: Nov. 23, 1999

[54] STENCIL PRINTING METHOD AND PRINTER USING THE SAME

[75] Inventor: Hideyuki Kagawa, Sendai, Japan

[73] Assignee: Tohoku Ricoh Co., Ltd., Miyagi-ken, Japan

[21] Appl. No.: 08/926,423

[22] Filed: Sep. 9, 1997

[30] Foreign Application Priority Data

Dec. 27, 1996 [JP] Japan ..... 8-350346

[51] Int. Cl.[6] ..... B41C 1/14

[52] U.S. Cl. ..... 101/128.4; 101/116

[58] Field of Search ..... 101/114, 116, 101/117, 118, 128.21, 128.4, 129, 127, DIG. 36

[56] References Cited

U.S. PATENT DOCUMENTS

| | | | |
|---|---|---|---|
| 5,207,157 | 5/1993 | Okazaki et al. | 101/116 |
| 5,224,419 | 7/1993 | Fukai | 101/128.4 |
| 5,575,205 | 11/1996 | Iida | 101/116 |
| 5,632,200 | 5/1997 | Fukai | 101/116 |
| 5,640,904 | 6/1997 | Sato et al. | 101/128.4 |
| 5,662,039 | 9/1997 | Watanabe et al. | 101/116 |

FOREIGN PATENT DOCUMENTS

| | | | |
|---|---|---|---|
| 61-287781 | 12/1986 | Japan | 101/477 |
| 6-51421 | 7/1994 | Japan . | |
| 7-25127 | 1/1995 | Japan . | |
| 7-257002 | 10/1995 | Japan . | |

*Primary Examiner*—Christopher A. Bennett
*Attorney, Agent, or Firm*—Oblon, Spivak, McClelland, Maier & Neustadt, P.C.

[57] ABSTRACT

In a stencil printer, when a print drum reaches a stand-by position where a new master produced by a master making operation should have its leading edge clamped on the drum, a master discharging operation under way for discharging a used master is interrupted. After the leading edge of the new master has been clamped on the print drum, the master discharging operation is resumed while a master feeding operation for wrapping the new master around the print drum is under way. A printing operation for printing a document image on a sheet is effected simultaneously with the resumption of the master discharging operation. Such a procedure is implemented as a high speed 1 control mode and executed by a main control unit.

18 Claims, 32 Drawing Sheets

PRINT DRUM 2: TWO ROTATIONS ( INDICATING OF STOP )

PRINT DRUM 2 : 3 ROTATIONS ( INDICATING OF STOP )

PRINT DRUM 2 : 3 ROTATIONS ( INDICATING OF STOP )

| Fig. 23A | Fig. 23B | Fig. 23C |
|---|---|---|

PRINT DRUM 2 : 4 ROTATIONS ( INDICATING OF STOP )

STENCIL PRINTING METHOD AND PRINTER USING THE SAME

BACKGROUND OF THE INVENTION

The present invention relates to a printing method and a printer using the same and, more particularly, to a stencil printing method a printer using the same.

A printing method using a digital printer operable with a thermosensitive stencil is extensively used due to its simplicity. The digital printer using a thermosensitive stencil includes a master discharging operation for peeling a used master off a print drum and discarding it into a waste master box. In a master making operation, a stencil paid out from a stencil roll is conveyed by a platen roller while being selectively perforated, or cut, by a thermal head in accordance with an image signal representative of a document image. In a master feeding operation, the perforated stencil or master is wrapped around the print drum. Further, in a printing operation, ink is fed to the master wrapped around the drum in order to print the document image on a sheet. Such operations have customarily been independent of each other and sequentially effected one by one. This, however, increases a first print time (FPT hereinafter), i.e., the interval between the time when the operator presses a master make start switch or a start key and the time when the first printing is produced by the above procedure.

Printers using printing methods improved to reduce the FPT are disclosed in, e.g., Japanese Patent Laid-Open Publication Nos. 61-287781 and 7-257002. The printers taught in these documents each performs the master discharging operation and master making operation in parallel. A new master is temporarily accommodated in master stocking means. After the master discharging operation, the master is drawn out of the master stocking means and has its leading edge clamped by clamping means provided on a print drum. After the master has been fully wrapped around the print drum, a first printing or trial printing is produced. The printer proposed in the above Laid-Open Publication No. 7-257002 is capable of effecting the master feeding operation in parallel with the master making operation. Japanese Patent Publication No. 6-51421 proposes to make a master corresponding to a document while the printing operation using a master corresponding to the previous document is under way in order to increase the printing efficiency.

The printers disclosed in the above Laid-Open Publication Nos. 61-287781 and 7-257002 each is capable of making a master while discharging a used master, and feeding a sheet while making a master. However, such a printer is disadvantageous in that the master feeding operation cannot be effected until the master discharging operation ends, and that the printing operation cannot be effected until the master feeding operation ends. As a result, the print drum must make four full rotations during the interval between the time when the start key is pressed and the time when the print drum returns to its home position after the above sequence of steps. This printer therefore cannot operate rationally in such a way to reduce the FPT, i.e., needs a long FPT. Further, the scheme taught in the above Publication No. 6-51421 cannot perform the discharge of the used master corresponding to the preceding document and the making and feeding of the master corresponding to the following document and printing using it at the same time.

SUMMARY OF THE INVENTION

It is therefore an object of the present invention to provide a printing method capable of effecting a master discharging operation and a master feeding operation in parallel and/or effecting the master feeding operation and a printing operation in parallel in order to reduce the required amount of rotation of a print drum and therefore the FPT, and a printer using the same.

It is another object of the present invention to provide a printer capable of reducing the FPT without changing the configuration of a conventional printer except for a control unit.

It is yet another object of the present invention to provide a printing method capable of realizing higher registration accuracy and lower noise at the time of sheet feed during printing, and a printer using the same.

It is a further object of the present invention to provide a printer capable of further reducing the FPT by the rational arrangement of a master discharging section and a master making section.

In accordance with the present invention, a stencil printing method includes a master discharging operation for peeling a used master off a print drum and discharging the used master, a master making operation for making a single master in accordance with an image signal representative of a document image, a master feeding operation for wrapping the master around the print drum while clamping the leading edge of the master on the print drum, and a printing operation for feeding, after the master feeding operation, ink to the master to thereby print the document image on a sheet. While the master discharging operation is under way, it is interrupted when the print drum reaches a stand-by position for awaiting said master. After the leading edge of the master has been clamped on the print drum during the master feeding operation, the master discharging operation is resumed while the master feeding operation is under way. The printing operation is effected after the master feeding operation.

Also, in accordance with the present invention, a printer includes a print drum. A master discharging section peels a used master off a print drum and discharging the used master. A master making section makes a single master in accordance with an image signal representative of a document image. A master feeding section wraps the master around the print drum while clamping the leading edge of the master on the print drum. A printing section feeds, after the master feeding operation, ink to the master to thereby print the document image on a sheet. While the master discharging operation is under way, it is interrupted when the print drum reaches a stand-by position for awaiting the master. After the leading edge of the master has been clamped on the print drum during the master feeding operation, the master discharging operation is resumed with the master feeding operation being effected. The printing operation is effected after the master feeding operation.

Further, in accordance with the present invention, in a stencil printing method including a master discharging operation for peeling a used master off a print drum and discharging the used master, a master making operation for making a single master in accordance with an image signal representative of a document image, a master feeding operation for wrapping the master around the print drum while clamping the leading edge of the master on the print drum, and a printing operation for feeding ink to the master wrapped around the print drum to thereby print the document image on a sheet, after the master feeding operation the printing operation is effected with the master feeding operation being effected.

Furthermore, in accordance with the present invention, a printer includes a print drum. A master discharging section peels a used master off a print drum and discharges the used master. A master making section makes a single master in accordance with an image signal representative of a document image. A master feeding section wraps the master around the print drum while clamping the leading edge of the master on the print drum. A printing section feeds ink to the master wrapped around the print drum to thereby print the document image on a sheet. After the master discharging operation, the printing operation is effected with the master feeding operation being effected.

Moreover, in accordance with the present invention, a stencil printing method includes a master discharging operation for peeling a used master off a print drum and discharging the used master, a master making operation for making a single master in accordance with an image signal representative of a document image, a master feeding operation for wrapping the master around the print drum while clamping the leading edge of the master on the print drum, and a printing operation for feeding, after the master feeding operation, ink to the master to thereby print the document image on a sheet. While the master discharging operation is under way, it is interrupted when the print drum reaches a stand-by position for awaiting the master. After the leading edge of the master has been clamped on the print drum during the master feeding operation, the master discharging operation is resumed while the master feeding operation is under way, and the printing operation is effected at the same time as the resumption of the master discharging operation.

In addition, in accordance with the present invention, a printer includes a master discharging section for peeling a used master off a print drum and discharging the used master. A master making section makes a single master in accordance with an image signal representative of a document image. A master feeding section wraps the master around the print drum while clamping the leading edge of the master on the print drum. A printing section feeds, after the master feeding operation, ink to the master wrapped around the print drum to thereby print the document image on a sheet. While the master discharging operation is under way, the master discharging operation is interrupted when the print drum reaches a stand-by position for awaiting the master. After the leading edge of the master has been clamped on the print drum during the master feeding operation, the master discharging operation is resumed with the master feeding operation being effected, and at the same time the printing operation is effected.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
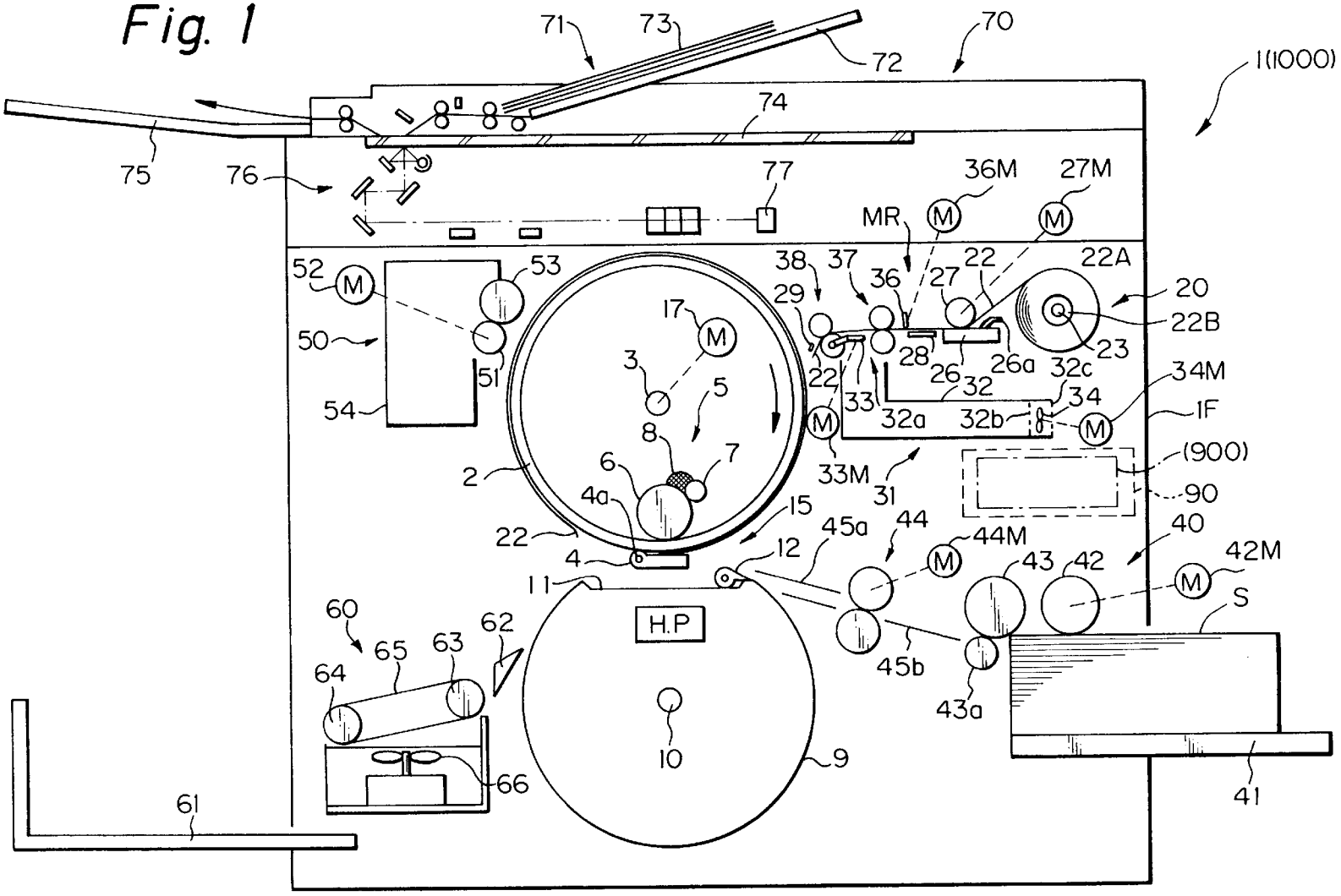
FIG. 1 is a front view showing a stencil printer embodying the present invention.

To better understand the present invention, reference will be made to a stencil printer using a conventional printing method, shown in FIGS. 1–3 and 23. As shown in FIG. 1, the printer, generally (1,000), includes a main control unit (900) and a frame 1F.

A document reading section 70 has a glass platen 74, an ADF (Automatic Document Feeder) 71, and a scanner 76. The glass platen 74 is mounted on the top of the frame 1F in order to be loaded with a document. The ADF 71 automatically conveys a document or documents 73 stacked on a feed tray 72 to a preselected position on the scanner 76 one by one. The scanner 76 is positioned beneath the glass platen 74 in order to read the image of the document 73 conveyed thereto by the ADF 71. A master making section 20 is arranged below the document reading section 70 at one side of the frame 1F and perforates, or cuts, a stencil 22 paid out from a stencil roll 22A. A printing section 15 is positioned substantially at the center of the frame 1F and includes a print drum 2. The perforated part of the stencil 22, i.e., a master 22 is wrapped around the print drum 2. A sheet feeding section 40 is located below the master making section 20 and feeds sheets S stacked on a sheet tray 41 toward the printing section 15 one by one. A sheet discharging section 60 is located in the lower portion of the frame 1F facing the sheet feeding section 40. The sheet discharging section 60 drives the sheet coming out of the printing section 15, i.e., a printing out of the frame 1F onto a printing tray 61. A master discharging section 50 is positioned between the sheet discharging section 60 and the document reading section 70 and includes a waste master box 54. A used master 22 peeled off the print drum 2 is discharged into the waste master box 54 by the master discharging section 50. The main control unit (900) (indicated by a phantom line) is disposed between the master making section 20 and the sheet feeding section 40 and controls the entire printer (1,000), as will be described with reference to FIG. 23 later.

The document reading section 70, master making section 20, printing section 15, sheet feeding section 40 and sheet discharging section 60 will be described more specifically hereinafter.

The ADF 71 includes a discharge tray 75 in addition to the feed tray 72 and is bodily openable away from the glass platen 74. The ADF 71 is provided with an automatic document feeding mechanism taught in, e.g., Japanese Patent Publication No. 7-97813 (FIG. 1). The scanner 76 has conventional optics including a lens and an image sensor 77. When an imagewise reflection from the document 73 is incident to the image sensor 77 via the lens, the image sensor 77 transforms it to a corresponding electric image signal. The image signal output from the image sensor 77 is routed through an analog-to-digital converter (ADC) board to a master making control board, not shown, electrically connected to the main control unit (900). The scanner 76 may have a configuration disclosed in, e.g., Japanese Patent Laid-Open Publication No. 4-189544.

Figure 2:
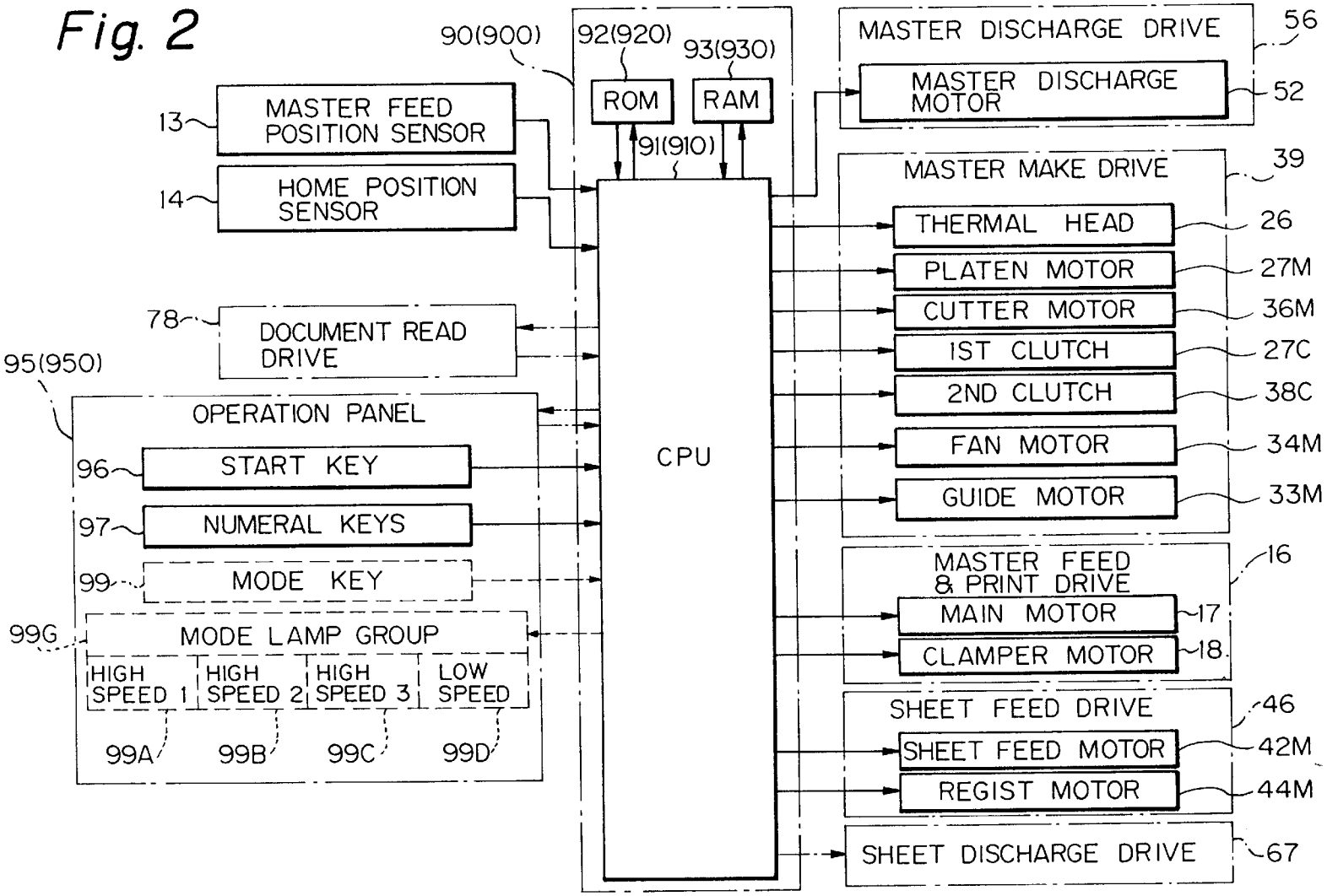
FIG. 2 is a block diagram schematically showing a control system included in the embodiment.

In a control system shown in FIG. 2, a motor, not shown, for driving various rollers included in the ADF 71 and other drive sections of the ADF 71 and a motor, not shown, for driving the optics of the scanner 76 and other drive sections included in the scanner 76 are represented by a document read drive 78.

The master making section 20 includes a roll support member 23 supporting the stencil roll 22A such that the stencil 22 can be paid out from the roll 22A. A thermal head 26 is positioned on a stencil transport path MR downstream of the master support member 23. The thermal head 26 selectively perforates the stencil 22 by heating it in accordance with the image signal. A platen roller 27 is rotatable while pressing the stencil 22 against the thermal head 26. A cutter 36 is positioned on the stencil transport path MR downstream of the platen roller 27 in order to cut off the perforated stencil or master 22. A first guide plate 28 extends between the platen roller 27 and the cutter 36 on the master transport path MR. A pair of first conveyor rollers 37 positioned one above the other and a pair of second conveyor rollers 38 also positioned one above the other are located on the master transport path MR downstream of the cutter 36. Master stocking means 31 is arranged below the master transport path MR between the first and second conveyor roller pairs 37 and 38 and includes a warp box 32 and a guide 33. A second guide plate 29 is located on the master transport path MR downstream of the second conveyor roller pair 38.

The stencil 22 is rolled on a tubular core 22B, constituting the stencil roll 22A. The core 22B protrudes from both ends of the roll 22A. For the stencil 22, use may be made of a laminate consisting of a thermoplastic resin film formed of polyester and as thin as 1 $\mu$m to 2 $\mu$m and a porous substrate adhered to the film. The porous substrate is formed of, e.g., the fibers of Japanese paper or synthetic fibers or a mixture thereof. The stencil 22 is perforated by heat generated by the thermal head 26. The master support member 23 is mounted on side walls, not shown. The core 22B is removably and rotatably supported by the member 23 at both ends thereof.

The thermal head 26 has a plurality of heating elements arranged in the main scanning direction corresponding to the axial direction of the platen roller 27. A current is selectively fed to the heating elements. As a result, the heating elements selectively generate heat and thereby selectively perforate the stencil 22, as well known in the art. The head 26 is selectively moved into and out of contact with the platen roller 27 by a mechanism, not shown. A head guide plate 26*a* for protecting a head drive section is positioned on the master transport path MR upstream of the head 26 and extends in the main scanning direction of the head 26 in parallel to the head 26. The head guide plate 26*a* is bent obliquely upward from the left to the right, as seen in a front view, and extends in parallel with the top of the head 26. The head guide plate 26 serves to guide the stencil 22 paid out from the roll 22A smoothly into the gap between the head 26 and the platen roller 27.

The platen roller 27 is rotatably supported by the previously mentioned side wall via a roller shaft, not shown. A platen motor 27M is drivably connected to the roller shaft via, e.g., a pulley and a timing belt, not shown. The platen roller 27 driven by the motor 27M conveys the stencil 22 to the downstream side of the master transport path MR while pressing it against the head 26. A first electromagnetic clutch 27C (shown only in FIG. 2) intervenes between the roller shaft and the pulley in order to selectively interrupt the drive transmission from the motor 27M to the platen roller 27. The motor 27M is implemented by a stepping motor.

The cutter 36 is implemented by a conventional rotary edge. A cutter motor 36M causes the cutter 36 to move in the widthwise direction of the stencil 22 while in rotation. The downstream end of the first guide plate 28 plays the role of the stationary edge of the cutter 36. While the cutter 36 is not operated, it is retracted to one side of the master transport path MR so as not to interfere with the stencil 22 being conveyed.

The upper roller and lower upper of the first roller pair 37 are respectively implemented as a drive roller and a driven roller. The drive roller is operatively connected to the platen motor 27M via a pulley and an endless belt, not shown. Likewise, the upper roller and lower roller of the second roller pair 38 are implemented as a drive roller and a driven roller, respectively; the drive roller is connected to the platen motor 27M via a second electromagnetic clutch 38C (shown only in FIG. 2) and rotation transmitting means, e.g., a pulley and an endless belt, not shown. The clutch 38C selectively interrupts drive transmission from the motor 27M to the second roller pair 38.

The master stocking means 31 has, in addition to the warp box 32 and guide 33, a guide motor 33M, a suction fan 34, and a fan motor 34M. The master stocking means 31 causes the master 22 to form a warp while temporarily accommodating the warp therein.

The warp box 32 is bent in the form of a letter L toward the downstream side of the master transport path MR. The box 32 sequentially receives the master 22 forming a warp. The guide 33 is movable between a guide position beneath the master transport path MR and a warp position below the guide position. At the warp position, the guide 33 is held in an upright position at the right-hand side of the lower portion of the second roller pair 38, as seen in FIG. 1. While the guide 33 is in its warp position, the space above the warp box 32 is unblocked, forming a opening 32*a* for introducing the master 22 into the box 32. A sector gear, not shown, is mounted on the guide 33 in order to cause the guide 33 to move between the guide position and the warp position about a shaft, not shown, formed integrally with the left end of the guide 33. A guide motor 33M is mounted on the previously mentioned side wall. A drive gear, not shown, is mounted on the output shaft of the guide motor 33M and constantly held in mesh with the above sector gear.

Inlet holes 32*b* and outlet holes 32*c* are formed in the rear of the warp box 32 positioned at the downstream side of the master transport path MR. The holes 32*b* and 32*c* are implemented as slits or meshes. The suction fan 34 is interposed between the inlet holes 32*b* and the outlet holes 32*c* and driven by the fan motor 34M. While the fan 34 is in rotation, it produces a stream of air flowing from the left to the right, as seen in FIG. 1, with the result that the master 22 is caused to sequentially warp.

After the master 22 has been cut off from the stencil 22, the guide motor 33M is driven forward in order to move the guide 33 to its guide position via the sector gear and drive gear. At the guide position, the guide 33 guides the master 22 such that the leading edge of the master 22 reaches a master make stand-by position shown in FIG. 1 without falling into the warp box 31 via the opening 32*a*. After the guide 33 has been moved to the guide position, the guide motor 33M is reversed. As a result, after the leading edge of the master 22 has been nipped between the rollers of the second roller pair 38 and brought to the above stand-by position, the guide 33 is again moved to the warp position. The operation of the master stocking means 31 will be only briefly mentioned in the following description and is not shown in timing charts which will be referenced in relation to the embodiments of the present invention.

The second guide plate 29 steers the leading edge of the master 22 substantially vertically downward. The second roller pair 38 conveys the stencil 22 at a slightly higher speed than the platen roller 27.

The thermal head 26, platen motor 27M, cutter motor 36M, first and second electromagnetic clutches 27C and 38C, fan motor 34M, guide motor 33M and other drive sections to be controlled are represented by a master make drive 39 in FIG. 2.

In the printing section 15, the print drum 2 is mounted on a shaft 3 operatively connected to a main motor 17 via a gear train and belt transmission, not shown. A press drum, or pressing means, 9 is also operatively connected to the main motor 17 by a gear train, not shown, independent of the above gear train and the same belt transmission. The press drum 9 is rotated in synchronism with and at the same peripheral speed as the print drum 2. The main motor 17 is implemented as a DC motor for control.

A master clamper 4 for clamping the leading edge of the master 22 is mounted on the outer periphery of the drum 2 and extends along a line parallel to the axis of the shaft 3. The master clamper 4 is pivotally connected to the outer periphery of the print drum 2 by a shaft 4*a* and movable toward and away from the drum 2 about the shaft 4*a*. The master clamper 4 includes a rubber magnet. A stage, not shown, is affixed to the outer periphery of the print drum 2 and formed of a ferromagnetic material. When the print drum 2 is brought to a master discharge position or a master feed position which will be described, the master clamper 4 is moved away from the stage and then toward the stage by actuating means, not shown, mounted on the frame 1F. The actuating means includes a member, not shown, selectively engageable with the master clamper 4, and a clamper motor 18 (shown only in FIG. 2) which may be arranged in the same manner as in, e.g., Japanese Patent Laid-Open Publication No. 6-247031.

A master feed position sensor 13 (shown only in FIG. 2) and a home position sensor 14 (shown only in FIG. 2) are mounted on the frame 1F at a preselected position facing one end wall of the print drum 2. The master feed position sensor 13 is responsive to the master feed position of the print drum 2 where the master clamper 4 is positioned at the right-hand side of the print drum 2, as seen in FIG. 1. The home position sensor 14 is responsive to the home position of the print drum 2 where the master clamper 4 is positioned at the bottom of the drum 2, as shown in FIG. 1. These sensors 13 and 14 each is implemented as a conventional transmission type optical sensor having a light emitting element and a light-sensitive element. At the master discharge position, the master clamper 4 of the print drum 2 faces a peel roller 51 and a discharge roller 53 at the downstream side with respect to the direction of rotation of the drum 2. The home position sensor 14 is responsive to the master discharge position also. Specifically, when the print drum 2 is brought to its home position, the home position sensor 14 produces an ON signal. The amount of rotation (angle) of the print drum 2 is measured, via an optical rotary encoder or the like associated with the main motor 17, from the time when the sensor 14 outputs the ON signal, thereby sensing the master discharge position.

Ink feeding means 5 is arranged within the print drum 2. The ink feeding means 5 has an ink roller 6 for feeding ink to the inner periphery of the print drum 2, a doctor roller 7 parallel to the ink roller 6 and spaced from the roller 6 by a small gap, and an ink feed tube 3. The ink roller 6 and doctor roller 7 form an ink well 8 therebetween. The ink feed tube 3 plays the role of the shaft 3 at the same time and feeds ink to the ink well 8.

The press drum 9 adjoins the bottom of the print drum 2 and includes a sheet clamper 12. The press drum 9 presses the sheet S fed from the sheet feeding section 40 against the print drum 2 while clamping the leading edge of the sheet S with the sheet clamper 12. The press drum 2 has the same outside diameter as the print drum 2. A recess 11 is formed in a part of the outer periphery of the press drum 9 in order to prevent the drum 9 from interfering with the clamper 4 of the drum 2. A cam, not shown, is mounted on a bracket, not shown, angularly movable integrally with the press drum 9. The sheet clamper 12 is opened and closed on abutting against the cam. A shaft 10 on which the press roller 9 is mounted is angularly movable into and out of contact with the print drum 2 by being moved by conventional press roller moving means, not shown. The moving means includes a cam drive mechanism for pressing the press drum 9 against the print drum 2, and holding means, e.g., an arm, a spring or similar biasing means and a solenoid, not shown, for holding the drum 9 rotatably spaced from the drum 2. The above moving means may use an eccentric shaft, as taught in, e.g., Japanese Patent Laid-Open Publication No. 5-201115. The pressing means may alternatively be implemented by an ordinary press roller.

The main motor 17 included in the printing section 15 for driving the print drum 2 and press drum 9, the clamper motor 18, the solenoid of the press roller moving means, drive means, not shown, for driving the ink feeding means 5 and other drive sections to be controlled are represented by a master feed and print drive 16 in the system shown in FIG. 2.

The sheet feeding section 40 has, in addition to the sheet tray 41, a pick-up roller 42, separator rollers 43 and 43*a*, a pair of guides 45*a* and 45*b*, a registration roller pair 44, and an elevation motor, not shown.

The sheet tray 41 is loaded with a stack of sheets S and movable up and down relative to the frame 1F. Specifically, the elevation motor moves the sheet tray 41 up and down in accordance with the varying amount of the sheets S. The pick-up roller 42 and separator roller 43 rest on the uppermost sheet S. These rollers 42 and 43 are operatively connected to a sheet feed motor 42M via drive transmitting means, not shown, including a pulley and an endless belt. A one-way clutch, not shown, intervenes between the sheet feed motor 42M and each roller. While the motor 42M is in its OFF state, the rollers are freely rotatable in the direction in which the sheets S are fed out. Therefore, when a registration motor 44M is energized alone, the rollers are rotated by the sheet S in the sheet feed direction.

The registration roller pair 44 in the form of an upper roller and a lower roller is positioned downstream of the separator roller 43 in the sheet feed direction. The roller pair 44 serves as sheet transport synchronizing means. Specifically, when a single sheet S picked up by the pick-up roller 42 and separated by the separator roller 43 arrives at the roller pair 44, the roller pair 44 nips the leading edge of the sheet S and drives the leading edge at a preselected timing such that it meets the leading edge of an image formed in the master 22 wrapped around the print drum 2 and the sheet clamper 12 held in its open position. The registration motor 44M is drivably connected to the roller pair 44 via drive transmitting means, not shown, including a pulley and an endless belt. The registration motor 44M is implemented by a stepping motor. The guide plates 45*a* and 45*b* are affixed to side walls, not shown, included in the frame 1F so as to guide the sheet S.

When use is made of a press roller lacking the sheet clamper 12 or an ordinary press roller, the sheet S should only be fed to the gap between the print drum 2 and the press drum in synchronism with the leading edge of the image forming in the master 22 wrapped around the drum 2. The registration motor 44M may be replaced with mechanical cam driving means, if desired.

In FIG. 2, the sheet feed motor 42M, registration motor 44M, elevation motor and other drive sections included in the sheet feed section 40 are represented by a sheet feed drive 46.

The sheet discharging section 60 includes, in addition to the printing tray 61, a peeler 62, a discharge roller 63, an outlet roller 64, a conveyor belt 65, a suction fan 66, a sheet discharge motor, not shown, and a fan motor, not shown.

The peeler 62 is located in the vicinity of the press drum 9. When the sheet clamper 12 is opened to release the printed sheet or printing S, the peeler 62 peels the sheet S off the press drum 9. The discharge roller 63 and outlet roller 64 are rotatably supported by side walls, not shown, included in the sheet discharging section 60. The conveyor belt 65 is passed over the rollers 63 and 64 and formed with a plurality of perforations. When the sheet discharge motor drives the outlet roller 64, the rotation of the roller 54 is transferred to the discharge roller 63 by the conveyor belt 65. The suction fan 66 is positioned between the rollers 63 and 64 and driven by the fan motor. The suction fan 66 in rotation produces a stream of air directed downward, as viewed in FIG. 1, with the result that the printing S is retained on the conveyor belt 65 by suction. The operation of the sheet feeding section 60 is not shown in any one of timing charts which will be described hereinafter.

The sheet discharge motor, fan motor and other drive sections included in the sheet discharging section 60 are represented by a sheet discharge drive 67 in the system shown in FIG. 2.

The master discharging section 50 has a master discharge motor 52, a compressing plate, not shown, and a plate motor, not shown, in addition to the waste master box 54, peel roller 51, and discharge roller 53.

The peel roller 51 is pressed against the discharge roller 53 and driven by the master discharge motor 52. Moving means including a swingable arm selectively moves the peel roller 51 to an operative position pressed against the print drum 2 or to an inoperative position spaced from the drum 2. When the peel roller 51 is held at the inoperative position, the moving means is locked by locking means, not shown. This kind of configuration is disclosed in, e.g., FIGS. 1–5 of Japanese Utility Model Publication No. 2-274. The compressing plate is movable up and down within the box 54 by being driven by an elevating mechanism, not shown, which is driven by the plate motor.

The master discharge motor 52, plate motor and other drive sections included in the master discharging section 50 are represented by a master discharge drive 56 in FIG. 2.

Figure 3:
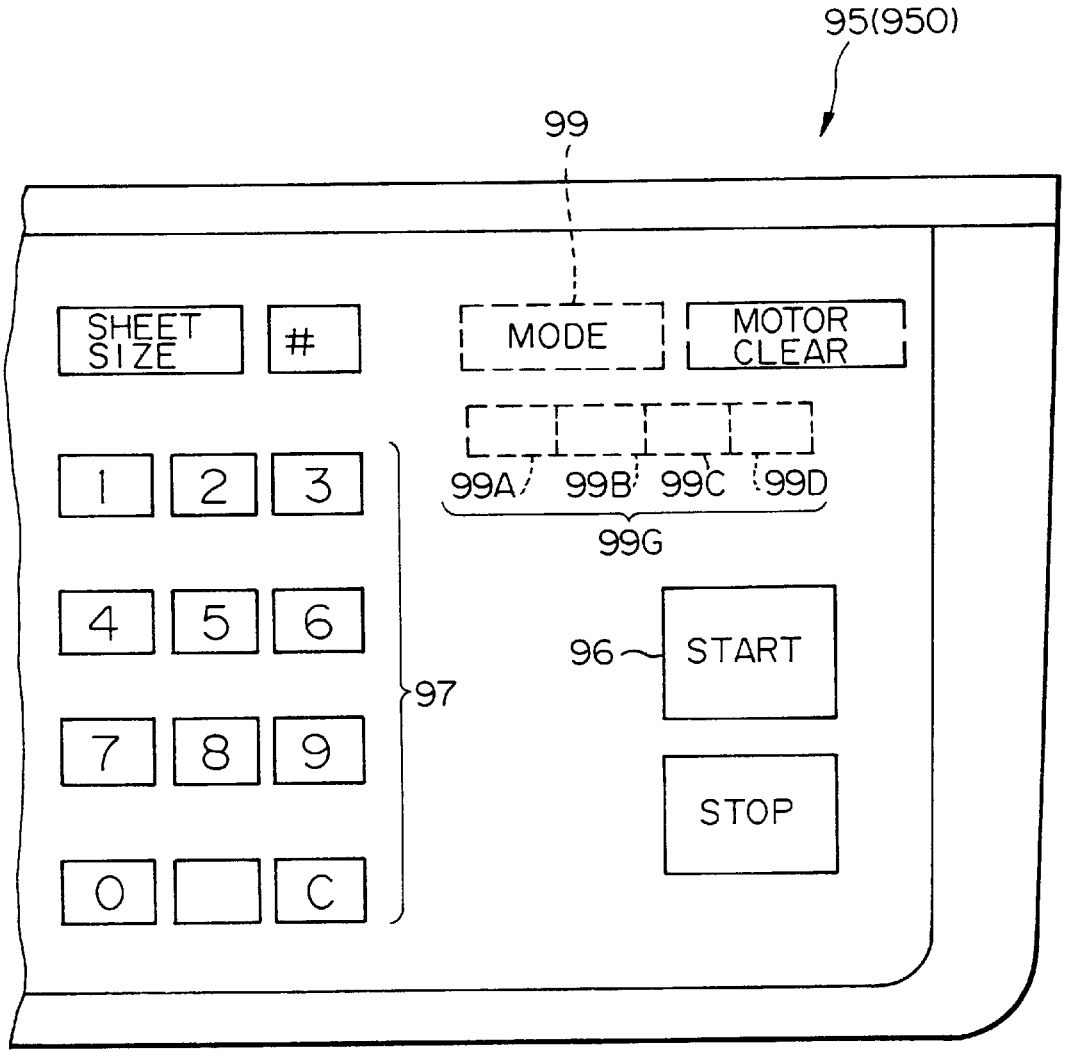
FIG. 3 is a plan view showing a specific arrangement of an operation panel also included in the embodiment.

An operation panel (950) shown in FIG. 2 is located in one end portion of the top of the document reading section 70 and accessible for manipulating the printer (1,000). As shown in FIG. 3 specifically, the operation panel (950) includes numeral keys 97 and a start key 96 each being arranged at a particular position. The numeral keys 97 are operated to enter a desired number of printings (or copies of printings) to be produced from the document 73, and the number of documents. The start key 96 is operated to start the sequence of steps of reading the document 73, making a master, producing a trial printing, and printing images on the desired number of sheets. The operation panel (950) additionally includes an LED (Light Emitting Diode) device, not shown, for displaying the desired number of printings and the number of documents set on the numeral keys 97.

Referring to FIG. 2, the main control unit (900) interchanges command signals, ON/OFF signals and data signals with the master feed position sensor 13, home position sensor 14, document read drive 78, operation panel (950), master discharge drive 56, master make drive 39, master feed print drive 16, sheet feed drive 46, and sheet discharge drive 67 via drivers and suitable electric circuits. With this configuration, the main control unit (900) constitutes a system for controlling the entire operation of the printer (1,000) including the start and stop of the various drive sections and various timings. It should be noted that a mode key 99 and a mode lamp group 99C indicated by phantom lines in FIG. 2 are unique to the present invention, as will be described later.

The main control unit (900) has a CPU (Central Processing Unit) (910), an I/O (Input/Output) port, not shown, a ROM (Read Only Memory) (920), and a RAM (Random Access Memory) (930) which are interconnected by a signal bus, not shown. The RAM (930) is used to temporary store the results of computation effected by the CPU (910), and ON/OFF signals and data signals input from the sensors and keys. The ROM (920) stores a program, data and so forth necessary for the CPU (910) to control the printer (1,000) in accordance with a timing chart which will be described. The program and data may be set by writing data in the ROM (920) beforehand or by replacing a ROM chip.

The main control unit (900) receives ON/OFF signals output from the master feed position sensor 13 and home position sensor 14 as well as ON/OFF signals and data signals output from the start key 96 and numeral keys 97.

The main control unit (900) sends command signals for controlling the start and stop and the timings of the document read drive 78, operation panel (950), master discharge drive 56, master make drive 39, master feed and print drive 16, sheet feed drive 46, and sheet discharge drive 67.

Reference will be made to FIGS. 1, 4–11, 23 and 24 for describing the operation of the entire printer (1,000). It is to be noted that a timing chart shown in FIG. 23 demonstrates the above operation of the printer (1,000) only to a degree sufficing the understanding and practicing. Because details of the timing chart is partly omitted or slightly exaggerated, a supplementary description will be made, as needed. In the following description, including the description of the illustrative embodiments, the time when the individual drive section to be controlled operates and the time when it stops operating will be sometimes referred to as "ON" and "OFF", respectively. Labels T1 through T18 shown in FIG. 23 and representative of times are also used in timing charts relating to the embodiments of the present invention and are representative of the same times. Further, the redundant description of the ON/OFF operation of the individual drive section will be sometimes omitted.

Figure 4:
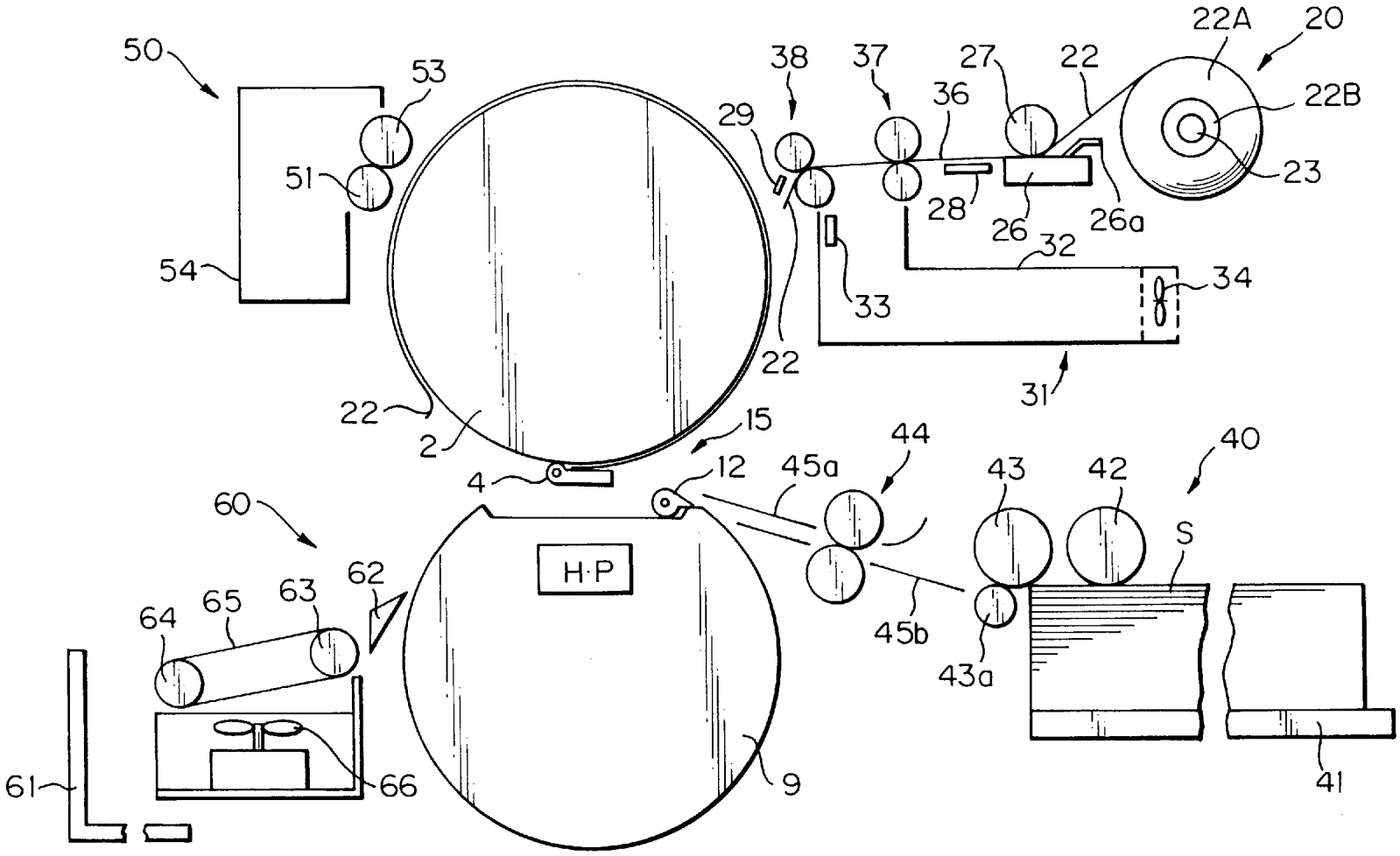
FIGS. 4–11 are fragmentary front views showing the printer of FIG. 1 in a sequence of steps constituting a first specific operation.

FIGS. 1 and 4 show the printer (1,000) in its initial position. As shown, the stencil 22 paid out from the roll 22A is held in its master make stand-by position with its leading edge nipped by the second roller pair 38. The print drum 2 is held in its home position. In FIG. 1, the operator stacks a plurality of documents 73 on the feed tray 72, and if the sheets S are absent on the sheet tray 41, replenishes the sheets S. Then, the elevation motor is turned on to elevate the sheet tray 41 until the uppermost sheet S contacts the pick-up roller 42 and separator roller 43. In this condition, the sheet feeding section 40 is ready to feed the sheets S.

Figures 23, 23A:
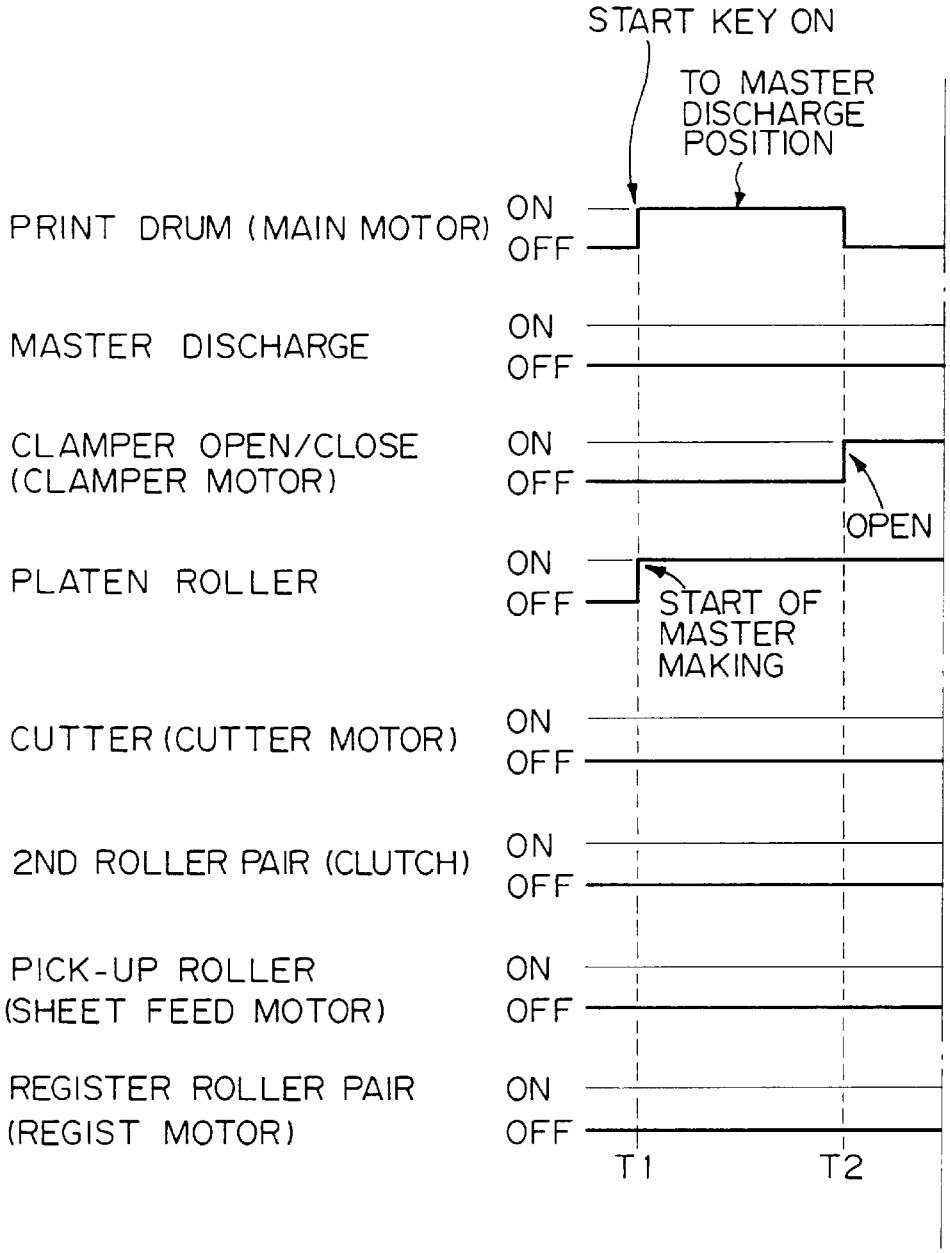
FIG. 23 is a timing chart representative of a fourth specific operation which is identical with a conventional operation.
Figure 23B:
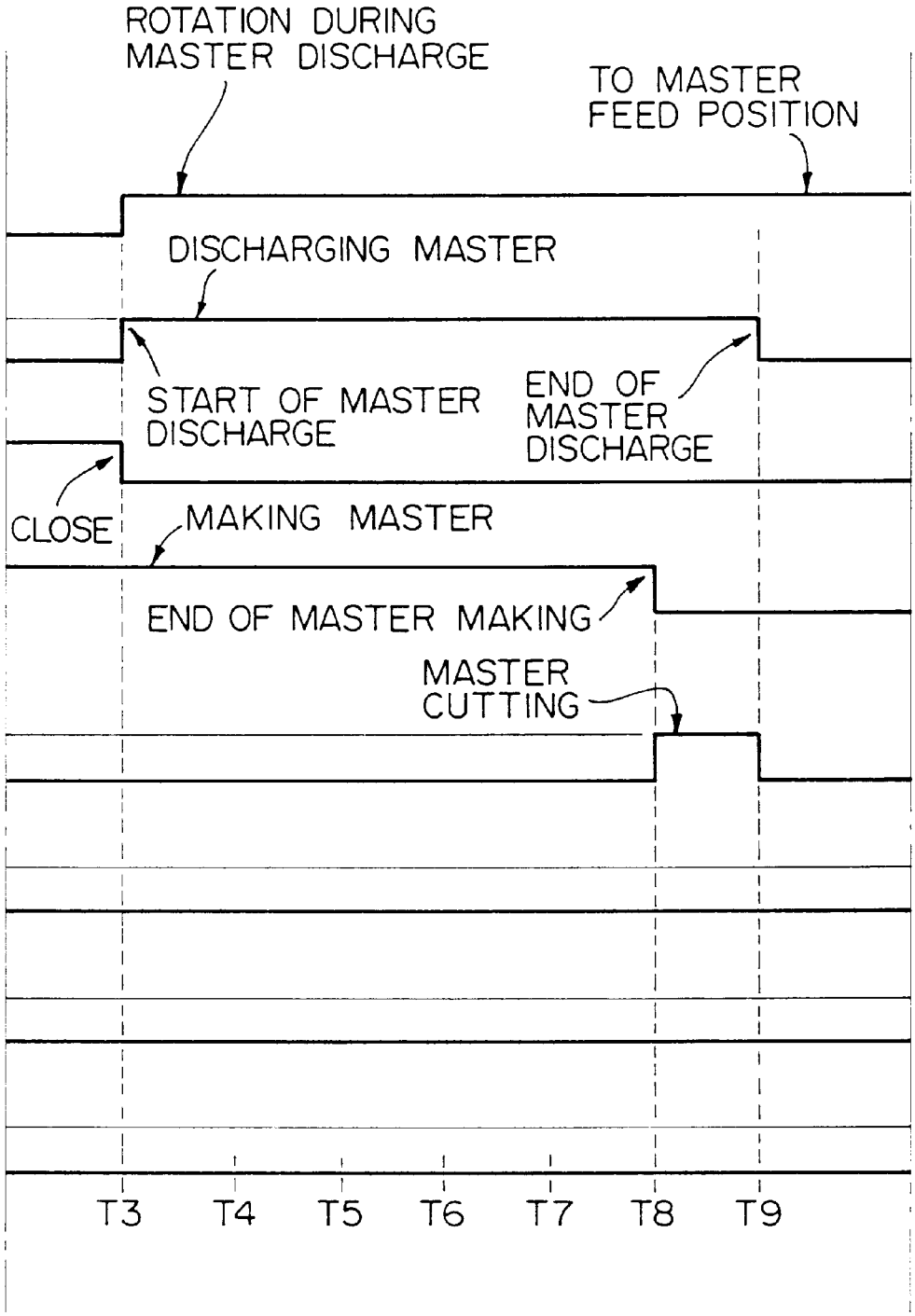
Figure 23C:
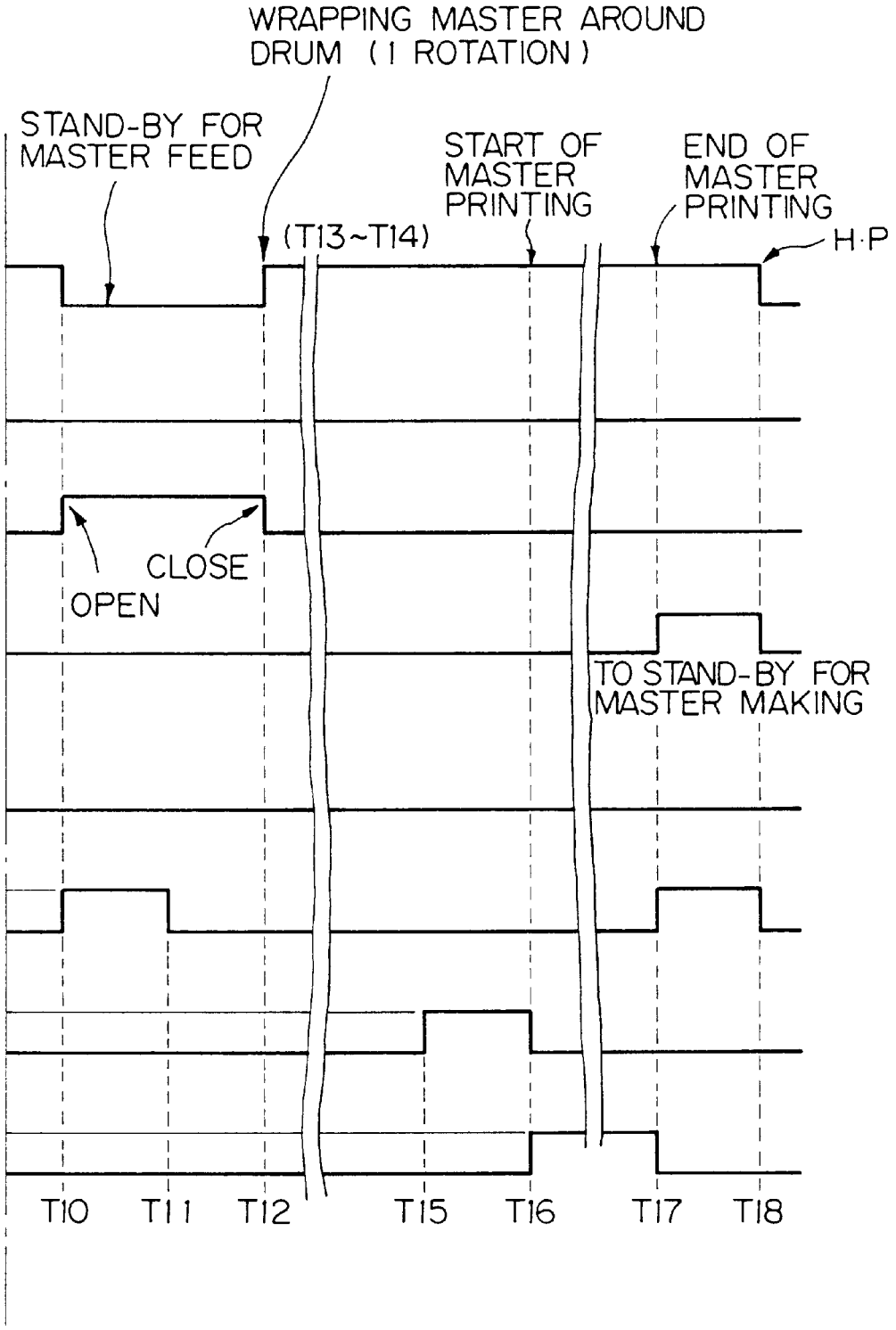

The operator presses the start key 96 (ON) at a time T1 shown in FIG. 23. As a result, a start signal is sent from the start key 96 to the main control unit (900). In response, the main control unit (900) executes the previously mentioned sequence of steps. First, the print drum 2 with a used master 22 wrapped therearound and held in its home position is caused to start rotating clockwise by the main motor 17. The home position sensor 14 generates an OFF signal and sends it to the main controller (900). In response, the main controller (900) so controls the main motor 17 as to stop the rotation of the print drum 2 at the master discharge position. During master discharge and master feed, the solenoid of the holding means included in the master feed and print drive 16 is deenergized, allowing the print drum 2 to rotate while being spaced from the press drum 9.

Figure 5:
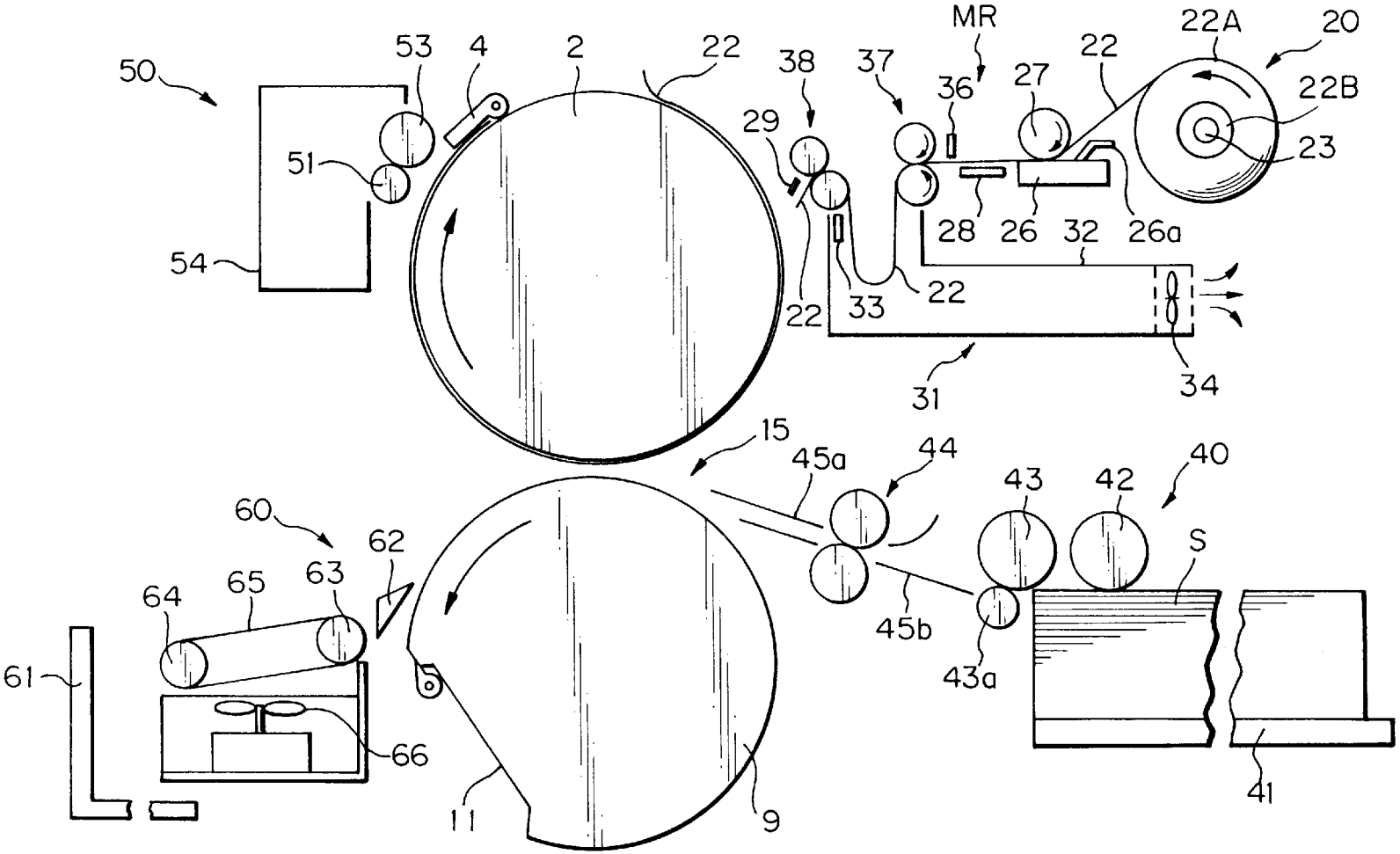
Figure 6:
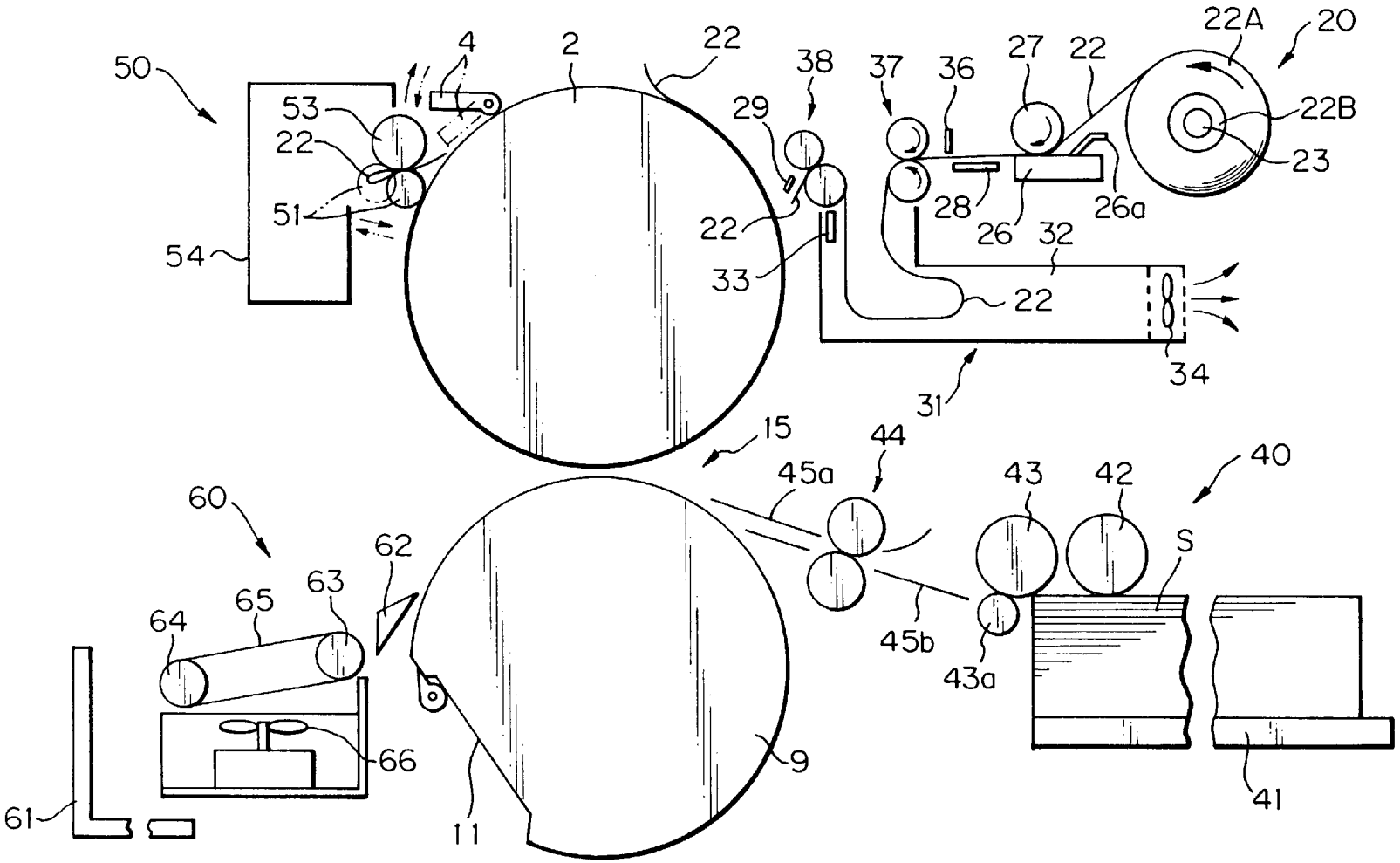

As also shown in FIG. 5, the main motor 17 is turned off at a time T2, stopping the rotation of the print drum 2 at the master discharge position. At the same time, as also shown in FIG. 6, the clamper motor 18 is energized in order to open the master clamper 4 for preparing for a master discharging operation, as indicated by a solid line in FIG. 6. The locking means is released from the moving means with the result that the peel roller 51 is brought to its operative position indicated by a solid line in FIG. 6, while at the same time the master discharge motor 52 is turned on. As a result, the peel roller 51 is rotated and pressed against a part of the print drum 2 corresponding to the leading edge of the used master 22. The peel roller 51 picks up and thereby peels the leading edge of the used master 22 off the print drum 2. Then, the peel roller 51 is immediately returned to its inoperative position indicated by a phantom line in FIG. 6, and rotatably held there together with the discharge roller 53. At a time T3 just after the return of the peel roller 51, the clamper motor 18 is turned off in order to close the master clamper 4. The main motor 17 is turned on to rotate the print drum 2 clockwise, starting the substantial master discharging operation. The peel roller 51 and discharge roller 53 nip the used master 22 and convey it while in rotation. Consequently, the used master 22 is sequentially peeled off the print drum 2 and introduced into the waste master box 54.

At the time T1, the document reading section 70 starts reading the document 73 while the master making section 20 starts making a master 22, in parallel with the movement of the print drum 2 to the master discharge position and the discharge of the used master 22. Specifically, the document read drive 73 is driven to cause the lowermost document 73 set on the feed tray 72 to be automatically transported to the preselected position on the glass platen 74. The optics reads the image of the document 73 while the image sensor 77 transforms the optical output of the optics to an electric image signal. The image signal is fed to the ADC board mentioned earlier. The document 73 read by the document reading section 70 is driven out onto the discharge tray 75. In parallel with the operation of the document reading section 70, the heating elements of the thermal head 26 selectively generate heat in accordance with a digital image signal output from the master making control board and undergone various kinds of image processing. As a result, the stencil 22 pressed against the head 26 by the platen roller 27 has its thermoplastic resin film selectively melted and perforated by the heat. At the same time, the platen motor 27M and first electromagnetic clutch 27C are energized to rotate the platen roller 27 and first roller pair 37 in the direction indicated by arrows in FIG. 5. Consequently, the perforated part of the stencil 22 is conveyed to the downstream side of the master transport path MR while being guided by the first guide plate 28. On the other hand, the second magnetic clutch 38C remains in its OFF state and prevents the rotation transferred to the platen roller 27M from being transferred to the second roller pair 38.

At the same time, the fan motor 34M is turned on to rotate the suction fan 34. The fan 34 generates a stream of air flowing rightward, as viewed in FIG. 6, along the contour of the warp box 32. The stream of air causes the perforated part of the stencil 22 to sequentially fall into the warp box 32 via the opening 32*a*. As a result, the perforated part of the stencil 22 is sequentially received in the box 32. Assume that the main control section (900) determines, based on the number of steps of the platen motor 27M, that the stencil 22 has been fully perforated over a length corresponding to a single master. Then, at a time T8, the main control unit (900) outputs commands for deenergizing the platen motor 207M and fan motor 34M. This ends the master making operation. At the same time, the cutter motor 36M is turned on to cause the cutter 36 to move in the widthwise direction of the stencil 22 while in rotation. Consequently, the perforated part of the master 22 is cut at its trailing edge, turning out a single master 22. At at time T9, the cutter motor 36M is turned off to cause the cutter 36 to stop operating.

Even after the end of the master making operation (time T8), the master discharging section 50 continues its operation. Specifically, the print drum 2 in clockwise rotation passes the master feed position and again reaches the master discharge position during the interval between the time T3 and the time T8. At a time T9, the used master 22 is fully removed from the print drum 2. When the entire used master 22 is discarded into the waste master box 54, the master discharge motor 52 is turned off, ending the master discharging operation (see FIG. 24). At the end of the master discharging operation, the print drum 2 is continuously rotated past the master discharge section. At this instant, the master feed position sensor 13 generates an OFF signal and sends it to the main control unit (900). In response, the main control unit (900) so controls the main motor 17 as to bring the print drum 2 to the master feed position. As a result, the master feed position sensor 13 generates an ON signal. In response, at a time T10, the main motor 17 is turned off and stops the rotation of the print drum 2 at the master feed position.

At the same time as the print drum 2 stops at the master feed position, the clamper motor 18 is turned on to open the master clamper 4. The print drum 2 is therefore held in a master feed stand-by state. Also, at the time T10, the first magnetic clutch 27C is turned off in order to interrupt the drive transmission from the platen motor 27M to the platen roller 27. At the same time, the second magnetic clutch 38C is turned on, and the platen motor 27M is turned on. As a result, the rotation of the platen roller 27M is transferred to the second roller pair 38 via the drive transmitting means. In response, the second roller pair 38 starts rotating and conveys the leading edge of the master 22 toward the master clamper 4 along the second guide plate 29. Assume that the main control unit (900) determines, based on the number of steps of the platen motor 27M, that the leading edge of the master 22 has reached the master clamper 4 at a time T11. Then, the main control unit (900) turns off the platen roller 27M and thereby stops the rotation of the second roller pair 38. Subsequently, the second magnetic clutch 38C is turned off.

At a time T12, the clamper motor 18 is turned off in order to close the master clamper 4. As a result, the leading edge of the master 22 is retained by the master clamper 4. At the same time, the main motor 17 is turned on in order to cause the print drum 2 to rotate clockwise. The second roller pair 38 is caused to rotate by the print drum 2 via the part of the master 22 existing therebetween. Consequently, the part of the master 22 received in the warp box 32 is sequentially drawn out of the box 32 and wrapped around the drum 2. Because the second roller pair 38 following the rotation of the print drum 2 exerts a load on the master 22, the master 22 is wrapped around the drum 2 without creasing. When the print drum 2 arrives at the master feed position third time after one full clockwise rotation, the master 22 has already been fully wrapped around the drum 22.

At a time T15, a sheet feeding operation begins in synchronism with the arrival of the print drum 2 at its home position. First, the sheet feed motor 42M is turned on. In response, the pick-up roller 42 and separator rollers 43 and 43*a* separate the uppermost sheet S from the other sheets and feed it toward the registration roller pair 44 away from the sheet tray 41. At this instant, the guide plates 45*a* and 45*b* guide the uppermost sheet S. At a time T16, the sheet feed motor 42 is turned off in order to stop the rotation of the rollers 42, 43 and 43*a*.

At the time T16, the registration motor 44M is turned on. In response, the registration roller pair 44 drives the sheet S at the preselected timing synchronous to the rotation of the print drum 2. The sheet clamper 12 is opened in synchronism with the rotation of the roller pair 44 and then closed after clamping the sheet S. The press roller 9 is rotated while retaining the sheet S thereon. As a result, the sheet S is conveyed to the nip between the print drum 2 and the press drum 9. At this time, the solenoid of the holding means included in the master make and print drive 16 is turned on in order to activate the cam drive mechanism. Consequently, the press drum 9 is pressed against the drum 2. After the printing operation, the solenoid is turned off in order to cause the cam drive mechanism to release the press drum 9 from the print drum 2. It is to be noted that the above description relating to the holding means will not be repeated even in relation to the illustrative embodiments. A spring, not shown, is included in the press drum moving means and constantly biases the press drum 9 toward the print drum 2. Therefore, the sheet S is pressed against the print drum 2 by the press roller 9 with the intermediary of the the master 22. At this time, the ink fed to the inner periphery of the print drum 2 by the ink roller 6 oozes out via the perforations of the master 22 and deposits on the sheet S, printing the document image on the sheet S.

Before the press drum 9 arrives at the peeler 62, the sheet clamper 12 is opened. As a result, the sheet S carrying the document image thereon gets on the peeler 62 and is peeled off thereby. The sheet S is driven onto the conveyor belt 65 by the sheet discharge drive 67 while being sucked by the suction fan 66. The conveyor belt 65 is driven by the outlet roller 64 and conveys the sheet S being sucked onto the belt 65. At a time T17, the sheet S is driven out onto the printing tray 61 as a trial printing. The print drum 2 is further rotated clockwise. At a time T18, the print drum 2 is returned to its home position and stopped there.

At the time T17, the registration motor 44M is turned off to stop the rotation of the registration roller pair 44. At the same time, in the master making section 20, the guide plate 33 is moved from the warp position to the guide position. The first electromagnetic clutch 27C and platen motor 27M are turned on in order to rotate the platen roller 27 and first roller pair 37. At the same time, the second electromagnetic clutch 38C is turned on, causing the second roller pair 38 to rotate. As a result, the next master 22 cut off by the cutter 36 has its leading edge conveyed to the downstream side of the master transport path MR by the roller pairs 37 and 38 while being guided by the guide 33 and second guide plate 29. At a time T18 when the leading edge of the above master 22 arrives at the master make stand-by position shown in FIG. 1, as determined on the basis of the number of steps of the platen motor 27M, the platen motor 27M is turned off. As a result, the platen roller 27 and first and second roller pairs 38 are brought to a stop.

In the foregoing description, the master make stand-by position is assumed to refer to the time when the leading edge of the master 22 is nipped by the second roller pair 38. In practice, however, the stand-by position refers to the time when the leading edge of the master 22 is nipped by the first roller pair 37. This prevents the wasteful consumption of the stencil 22.

After the above procedure, the operator sets a desired number of printings on the numerals keys 97 arranged on the operation panel 950, and again presses the start key 96. On receiving the resulting signal from the start key 96, the main control unit (900) repeats the same procedure as during trial printing the number of times corresponding to the desired number of printings.

Figure 24:
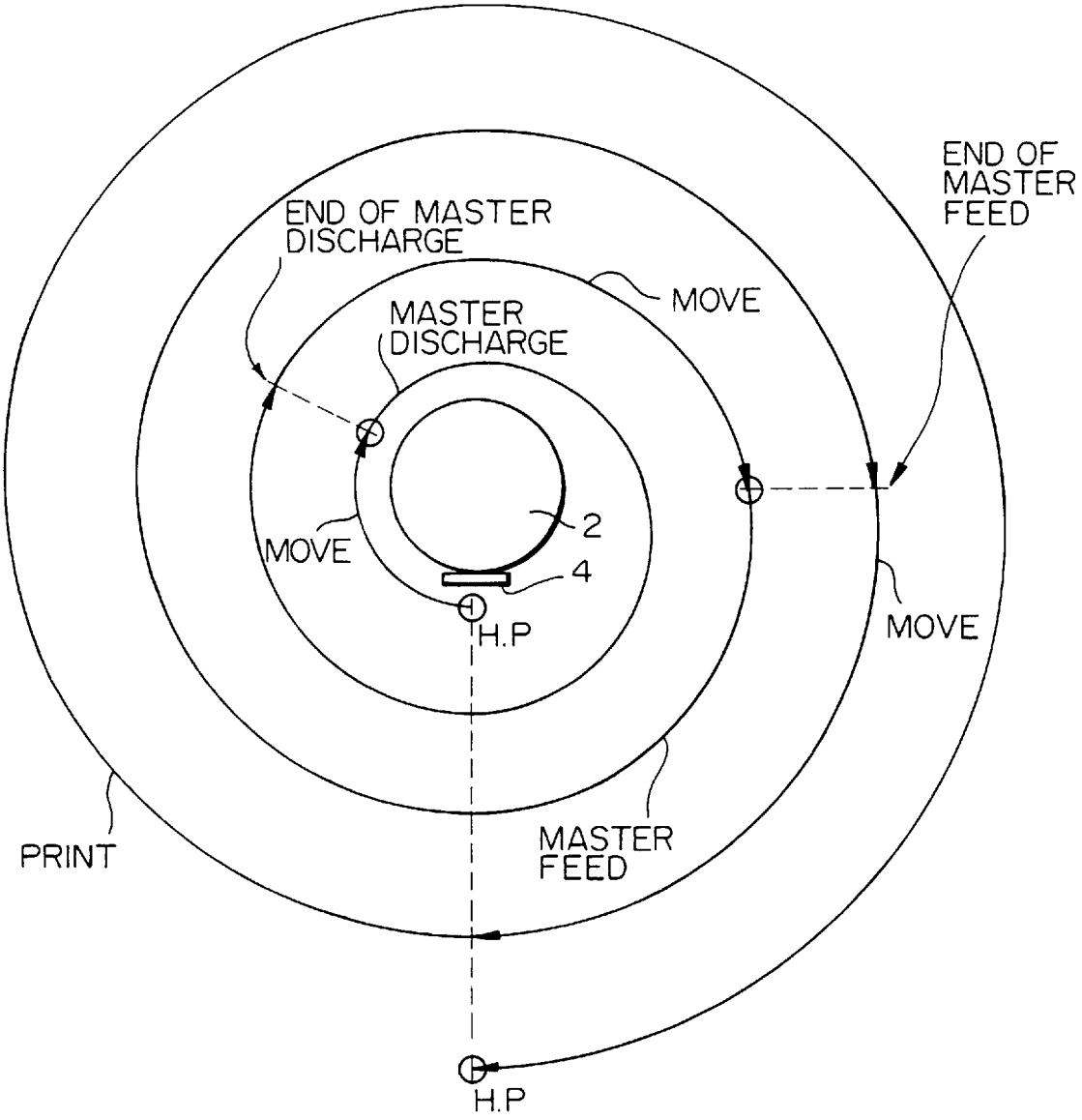
FIG. 24 shows consecutive conditions occurring in the fifth specific operation and the number of rotations of the print drum.

As stated above, the conventional printer (1,000) is capable of making a master while discharging a used master, and capable of feeding a sheet while making a master. However, the printer (1,000) is disadvantageous in that the master feeding operation cannot be effected until the master discharging operation ends, and that the printing operation cannot be effected until the master feeding operation ends. As a result, as shown in FIG. 24, the print drum 2 must make four full rotations during the interval between the time when the start key 96 is pressed and the time when the print drum 2 returns to its home position after the above sequence of steps. This printer (1,000) therefore cannot operate rationally in such a way to reduce the FPT, i.e., needs a long FPT. In this connection, in the timing chart shown in FIG. 23, the FPT is equal to T17−T1. Specifically, assuming that the print drum 2 has an outside diameter of 180 mm and rotates at a rate of 20 rpm (revolutions per minute), the FPT is as long as 18 seconds.

Preferred embodiments of the present invention will be described hereinafter with reference to the accompanying drawings. In the drawings, structural elements are suitably omitted for clear illustration. As for structural elements provided in pairs and do not have to be distinguished, only one of them will be described for the simplicity of description. In addition, the same structural elements as the elements of the conventional printer 1,000 are designated by the same reference numerals and will not be described in detail.

Referring again to FIG. 1, a stencil printer 1 using a printing method embodying the present invention is shown. The following description will concentrate on the differences between the conventional printer (1,000) and the printer 1. As shown in FIGS. 1 and 2, the printer 1 differs from the printer (1,000) in that it has an operation panel 95 in place of the operation panel (950) and has a main control unit or control means 90 (indicated by a dashed line in FIG. 1) in place of the main control unit (900).

As shown in FIGS. 2 and 3, the operation panel 95 differs from the operation panel (950) in that it additionally has the previously mentioned select key 99 and mode lamp group 99G. The mode lamp group 99G is made up of a high speed 1 mode lamp 99A, a high speed 2 mode lamp 99B, a high speed 3 mode lamp 99C and a low speed mode lamp 99D. These four lamps 99A–99D are implemented by LEDs and sequentially arranged in a horizontal array in this order in the upper right portion of the operation panel 95, as seen in FIG. 3.

The high speed 1 mode lamp turns on when a power switch, not shown, provided on the printer 1 is turned on, showing that a high speed 1 mode is set up. That is, the first high speed 1 mode is automatically set up without the mode key 99 being selected. The first high speed 1 mode is as follows. A master discharging operation under way is interrupted when the print drum 2 is brought to its master feed stand-by state ready to clamp the leading edge of a master 22 produced by a master making operation. After the leading edge of the master 22 has been clamped by the print drum 2, a master feeding operation for wrapping the master 22 around the drum 2 is effected, and the master discharging operation is resumed. At the same time, ink is fed to the stencil 22 on the print drum 2 so as to print an image on the sheet S. In a first specific operation which will be described, the printer 1 is operated in accordance with a timing chart shown in FIG. 12 and the movement of the print drum 2 shown in FIG. 13 under the control of the main control unit 90. The high speed 1 mode is selected when priority is given rather to the reduction of the FPT than to image quality.

The high speed 2 mode lamp 99B turns on when the mode key 99 is pressed once, showing that a high speed 2 mode is selected. The high speed 2 mode is as follows. A master discharging operation under way is interrupted when the print drum 2 reaches its master feed stand-by state ready to clamp the leading edge of the master 22 produced by a master making operation. After the leading edge of the master 22 has been clamped by the print drum 2, a master feeding operation is effected, and the master discharging operation is resumed. After the master feeding operation, a printing operation is effected. In a second specific operation which will be described, the printer 1 is operated in accordance with a timing chart shown in FIG. 15 and the rotation of the print drum 2 shown in FIG. 16 under the control of the main control unit 90. The high speed 2 mode is also selected, but next to the high speed 1 mode, when priority is given rather to the reduction of the FPT than to image quality.

The high speed 3 mode lamp 99C turns on when the mode key 99 is pressed twice, showing that a high speed 3 mode is selected. In this mode, a printing operation is effected while an operation for feeding the master 22 to the print drum 2 is under way. In a third specific operation which will be described, the printer 1 is operated in accordance with the rotation of the print drum 2 shown in FIG. 17 under the control of the main control unit 90. The high speed 3 mode gives substantially the same degree of priority to the reduction of the FPT as the high speed 2 mode.

The low speed mode lamp 99D turns on when the mode key 99 is pressed three times, showing that a low speed mode is selected. In the low speed mode, a master discharging operation and a master making operation are effected in parallel. After the master discharging operation has completed, the leading edge of the master 22 is clamped by the master clamper 4 and wrapped around the print drum 2. Subsequently, a printing operation is effected. The conventional procedure described with reference to FIG. 23 is an example of the low speed mode operation to be performed by the printer 1 under the control of the main control unit 90. This mode gives priority rather to image quality than to the reduction of the FPT.

The main control unit 90 differs from the main control unit (900) mainly in that it additionally causes the printer 1 to operate in accordance with a sequence of steps shown in FIGS. 4–11 and timing charts shown in FIGS. 12–17.

As shown in FIG. 2, the main control unit 90 interchanges command signals, ON/OFF signals and data signals with the master feed position sensor 13, home position sensor 14, document read drive 78, operation panel 95, master discharge drive 56, master make drive 39, master feed and print drive 16, sheet feed drive 46 and sheet discharge drive 67 via drivers and suitable electronic circuits The main control unit 90 therefore constitutes a system for controlling the start and stop and the timings of the above drive sections of the entire printer 1. The operation panel 95 includes the mode key 99 and mode lamp group 99G indicated by dashed lines in FIG. 2.

The main control unit 90 is implemented as a microcomputer and has a CPU 91, an I/O port, not shown, a ROM 92, and a RAM 93 which are interconnected by a signal bus, not shown. The RAM 93 temporarily stores the results of computation effected by the CPU 91 and the ON/OFF signals and data signals output from the sensors and keys. The ROM 92 stores a program and data for executing the operation of the printer 1 in accordance with the timing charts which will be described. The program and data are set by storing them in the ROM 92 in the form of data or by replacing a ROM chip.

The ON/OFF signals output from the master feed position sensor 13 and home position sensor 14 are sent to the main control unit 90. The ON/OFF signals and data signals output from the start key 96, numeral keys 97 and mode key 99 are also sent to the main control unit 90. The main control unit 90 outputs command signals for controlling the start and stop and the timings of the document read drive 78, operation panel 95, master discharge drive 56, master make drive 39, master feed and print drive 16, sheet feed drive 46 and sheet discharge drive 67 to be controlled.

First Specific Operation

Reference will be made to FIGS. 4–13 for describing a first specific operation, mainly differences between it and the conventional operation. Because the contents of the signals to be interchanged between the main control unit 90 and the drive sections and sensors will be readily understood from the conventional procedure and FIG. 2, they will not be described in detail in order to avoid redundancy.

In the specific operation 1, the operator is assumed to give priority rather to the reduction of the FPT than to image quality. First, when the operator turns on the power switch of the printer 1, the high speed 1 mode lamp 99A on the operation panel 95 turns on, showing that the high speed 1 mode is set. Then, the operator stacks the documents 73 on the feed tray 72, and if the sheets S are absent on the sheet tray 41, replenishes sheets.

As shown in FIGS. 1, 4–6, 12 and 13, from the time T1 to the time T3, the master discharge section 50, document reading section 70, master making section 20 and sheet feeding section 40 operate in the same manner as in the conventional procedure. Specifically, the rotation of the print drum 2 from its home position to its master discharge position, the stop of the drum 2 at the master discharge position, the opening and closing of the master clamper 4, and the master making operation are effected during the above interval.

Figure 7:
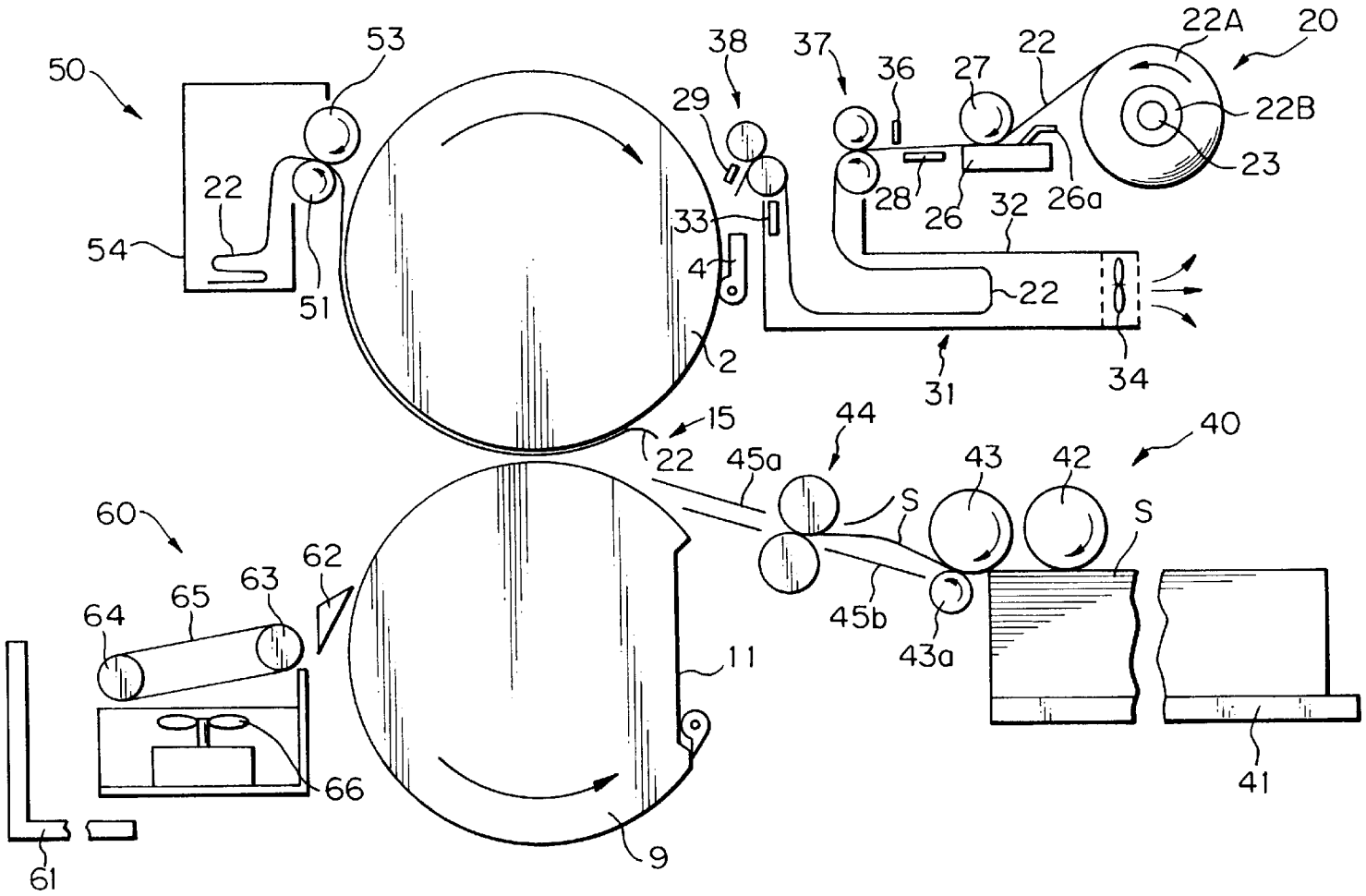

As shown in FIG. 7, the print drum 2 is caused to rotate clockwise at the time T3 and then stopped at the master feed position at the time T5. During the interval between the time T3 and the time T5, the master discharging section 50 continuously performs the master discharging operation with the peel roller 51, discharge roller 53 and so forth. The used master 22 is peeled off the print drum 2 by an amount corresponding to the angular movement of the print drum 2 and discharged into the waste master box 54. From the time T3 to the time T5, the first electromagnetic clutch 27C included in the master making section 20 is continuously turned on, causing the platen motor 27M to rotate. Therefore, the master making operation continues with the master stocking means 31 causing the new master 22 to warp.

At the time T4 when the master making operation is under way and when the print drum 2 is rotating toward its master feed position, the sheet feed motor 42M is turned on in order to rotate the pick-up roller 42 and separator roller pair 43 included in the sheet feeding section 40. As a result, the uppermost sheet S is fed out from the sheet tray 41 until its leading edge abuts against the nip of the registration roller pair 44. At the time T5, the sheet feed motor 42M is turned off in order to cause the roller 42 and roller pair 43 to stop rotating. In this condition, the sheet S has its leading edge held by the nip of the registration roller pair 44 and has its trailing edge held by the roller 42 and roller pair 43.

Figure 8:
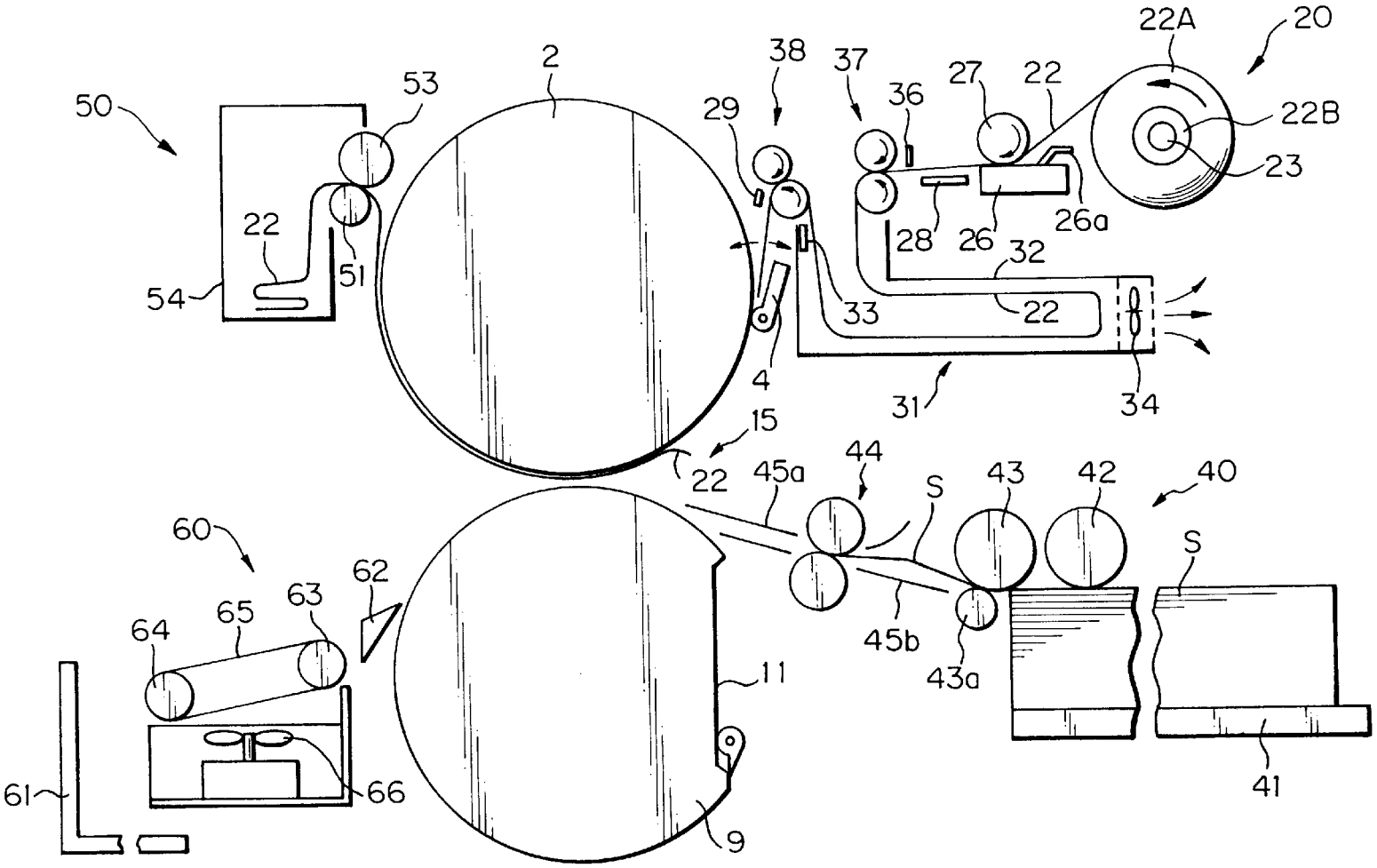

As shown in FIG. 8, at the time T5 when the print drum 2 is stopped at the master feed position, the master clamper 4 is opened. The print drum 2 is therefore held in its master feed stand-by position. At this time, the second magnetic clutch 38C is turned on with the result that the rotation of the platen motor 27M is transferred to the second roller pair 38 via the drive transmitting means. The second roller pair 38 is therefore rotated to feed the leading edge of the master 22 toward the master clamper 4 along the second guide 29. At the time T6 when the leading edge of the master 22 reaches the master clamper 4, as determined in terms of the number of steps of the platen motor 27M, the second electromagnetic clutch 38C is turned off in order to stop the rotation of the second roller pair 38.

As shown in FIG. 8, during the interval between the time T5 and the time T7, i.e., when the print drum 2 is held in the master make stand-by state, the master discharging operation of the master discharging section 50 is interrupted. At the time T7, the clamper motor 18 is turned off so as to close the master clamper 4. As a result, the leading edge of the master 22 is clamped by the master clamper 4.

Figure 9:
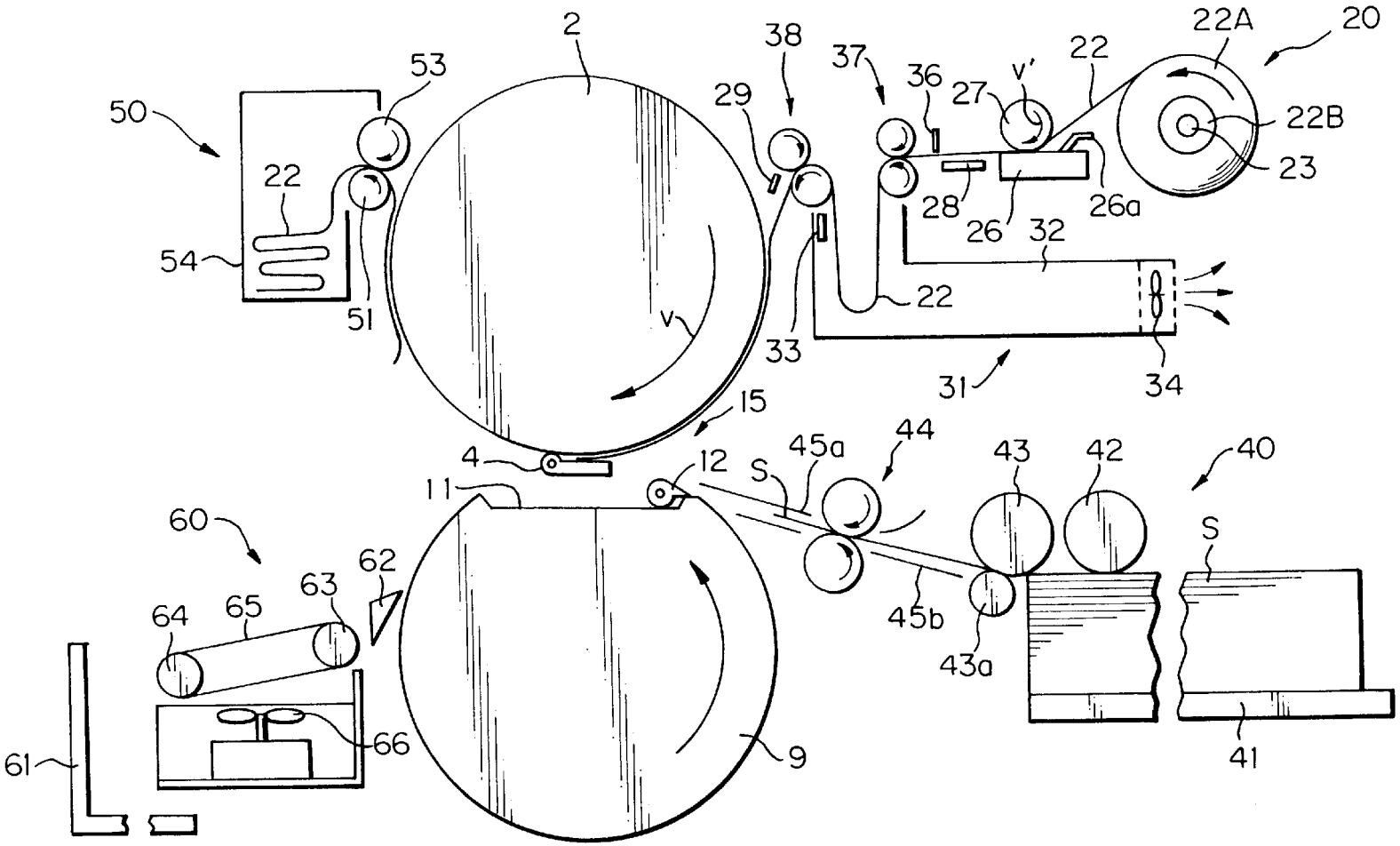

As shown in FIG. 9, at the above time T7, the master feeding operation occurs. Specifically, the main motor 17 is turned on in order to rotate the print drum 2 clockwise while causing the second roller pair 38 to follow the rotation of the drum 2. Consequently, the perforated part of the stencil 22 is sequentially drawn out of the warp box 32 and wrapped around the print drum 2. At this instant, the second roller pair 38 exerts a load on the perforated part of the stencil 22. The resulting tension acting on this part of the stencil 22 prevents it from creasing. The main control unit 90 controls the rotation speed of the main motor 17 and that of the platen motor 27M such that the print drum 2 moves at a peripheral speed $v$ sufficiently higher than a speed $v'$ at which the platen roller 27 conveys the stencil 22 ($v>v'$).

At the same time as the above master feeding operation is effected, the master discharge motor 52 of the master discharging section 50 is turned on in order to resume the master discharging operation. As a result, the used master 22 is peeled off the print drum 2 by the peel roller 51 and discharge roller 53 by an amount corresponding to the angular movement of the drum 2. Then, the used master 22 is discarded into the waste master box 54.

Figure 10:
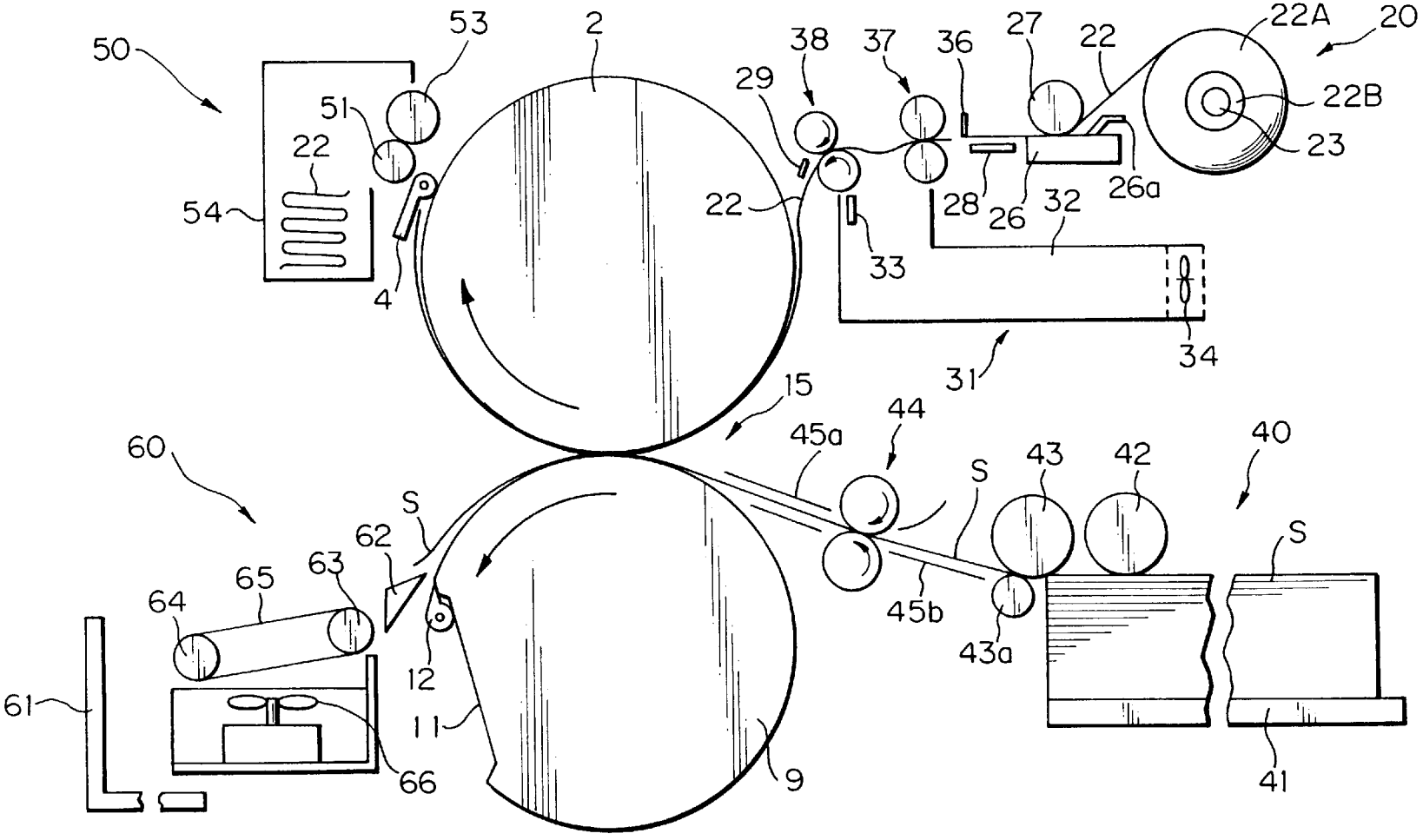

When the main control unit 90 determines, based on the number of steps of the platen motor 27M, that the stencil 22 has been perforated over a length corresponding to a single master, it turns off the platen motor 27M and suction fan motor 34M at the time T8. As a result, the platen roller 27, first roller pair 37 and suction fan 34 stop rotating, ending the master making operation (see FIG. 10). At this time, as shown in FIGS. 9 and 10, the warp of the perforated part of the stencil 22 present in the master stocking means 31 has decreased. At the time T8 when the warp of the stencil 22 becomes minimum, the cutter motor 36M is turned on in order to cause the cutter 36 to cut the trailing edge of the perforated part of the stencil 22 in the previously stated manner, thereby producing a master 22. At the time T9, the cutter motor 36M and therefore the cutter 36 stops operating.

As shown in FIGS. 9 and 10, around the time T9, the sheet feeding operation begins in synchronism with the rotation of the print drum 2 to its home position. Specifically, the registration motor 44M is turned on in order to cause the registration roller pair 44 to convey the sheet S at the timing synchronous to the rotation of the print drum 2. This is followed by the printing operation and sheet discharging operation stated earlier in relation to the conventional procedure.

Figure 13:
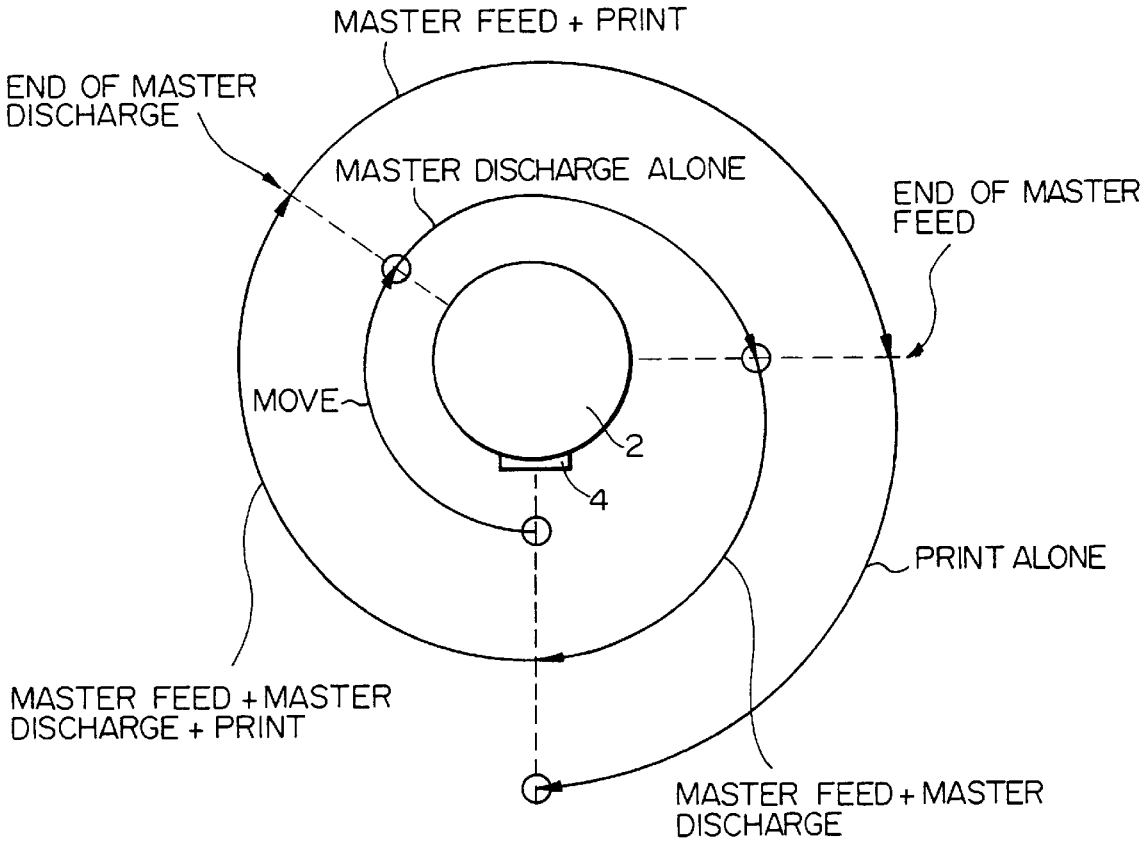
FIG. 13 shows consecutive conditions occurring in the first specific operation and associated with the rotation of a print drum and the stop of the rotation, and the number of rotations of the drum.

As shown in FIGS. 9, 10 and 13, the master discharging section 50 continuously performs the master discharging operation from the time T7 to the time T10 until the print drum 2 again arrives at the master discharge position. Around the time T10 when the print drum 2 again arrives at the master discharge position, the used master 22 is fully removed from the print drum 2 and discarded into the waste master box 54. Then, the master discharge motor 52 is turned off, completing the master discharging operation. At this time, the printing section 15 is performing the printing operation and sheet discharging operation, as stated above.

As shown in FIG. 13, assume that the print drum 2 is substantially brought to the master feed position after the printing operation and sheet discharging operation. At this time, the single new master 22 is fully wrapped around the print drum 2 (times T11 to T12). Subsequently, at the times T12 to T13, the printed sheet S is driven out onto the printing tray 61 as a trial printing. Then, at the time T14, the print drum 2 is rotated to the home position and stopped there.

Figure 11:
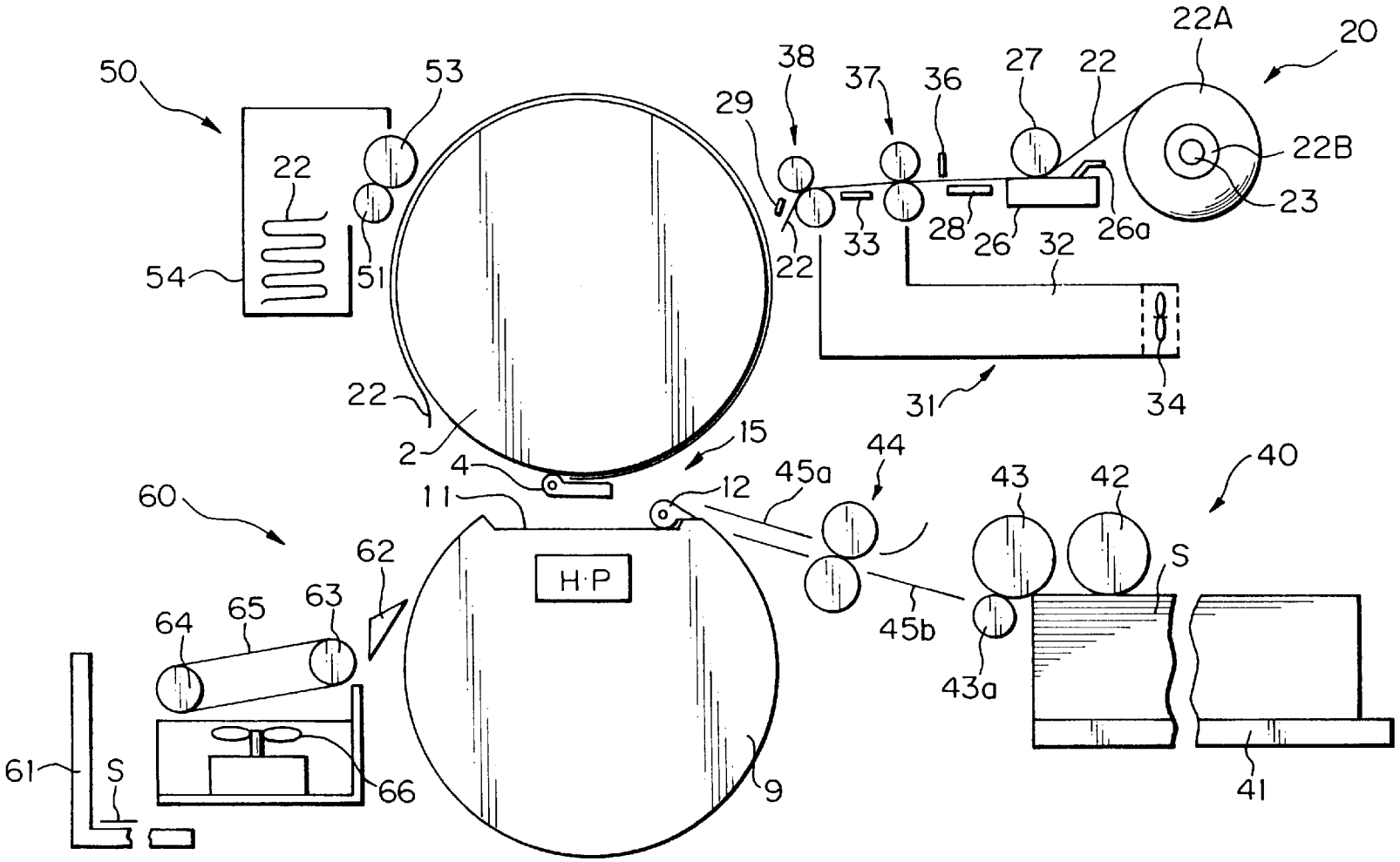

At the time T13, the registration motor 44M is turned off, ending the printing operation. Also, at the time T13, the guide 33 located at the master making section 20 is moved from warp position to its guide position. At the same time, the platen motor 27M is turned on with the result that the platen roller 27 and first roller pair 37 start rotating. Further, the second electromagnetic clutch 38C is turned on in order to rotate the second roller pair 37. Consequently, the leading edge of the next master 22 cut off by the cutter 36 is conveyed by the first and second roller pairs 37 and 38 to the downstream side of the master transport path MR while being guided by the guide 33 and second guide plate 29. At the time T14 when the leading edge of the above master 22 reaches the master make stand-by position shown in FIG. 1, as determined in terms of the number of steps of the platen motor 27M, the platen motor 27M is turned off. As a result, as shown in FIG. 11, the platen roller 27 and first and second roller pairs 37 and 38 stop rotating.

Thereafter, the operator sets a desired number of printings on the numeral keys 97 of the operation panel 95, as in the conventional procedure, and again presses the start key 96. This causes the printer 1 to repeat the above sheet feeding operation, printing operation and sheet discharging operation the number of times corresponding to the desired number of printings.

As shown in FIG. 13, in the first specific operation, the print drum 2 should only make two rotations from the time when the first printing is produced to the time when the drum 2 returns to its home position, reducing the FPT to T13–T1. Specifically, assuming that the print drum 2 has an outside diameter of 180 mm and rotates at a mean speed of 20 rpm, then the FPT (T13–T1) is only about 12 seconds which is about 6 seconds shorter than the conventional FPT. Further, this can be done without noticeably changing the configuration of the conventional printer except for, e.g., a part of the operation panel 95. In addition, because the sheet S is fed to the registration roller pair 44 beforehand while the master making operation is under way, there can be achieved higher registration accuracy and lower noise at the time of sheet feed.

Figure 14A:
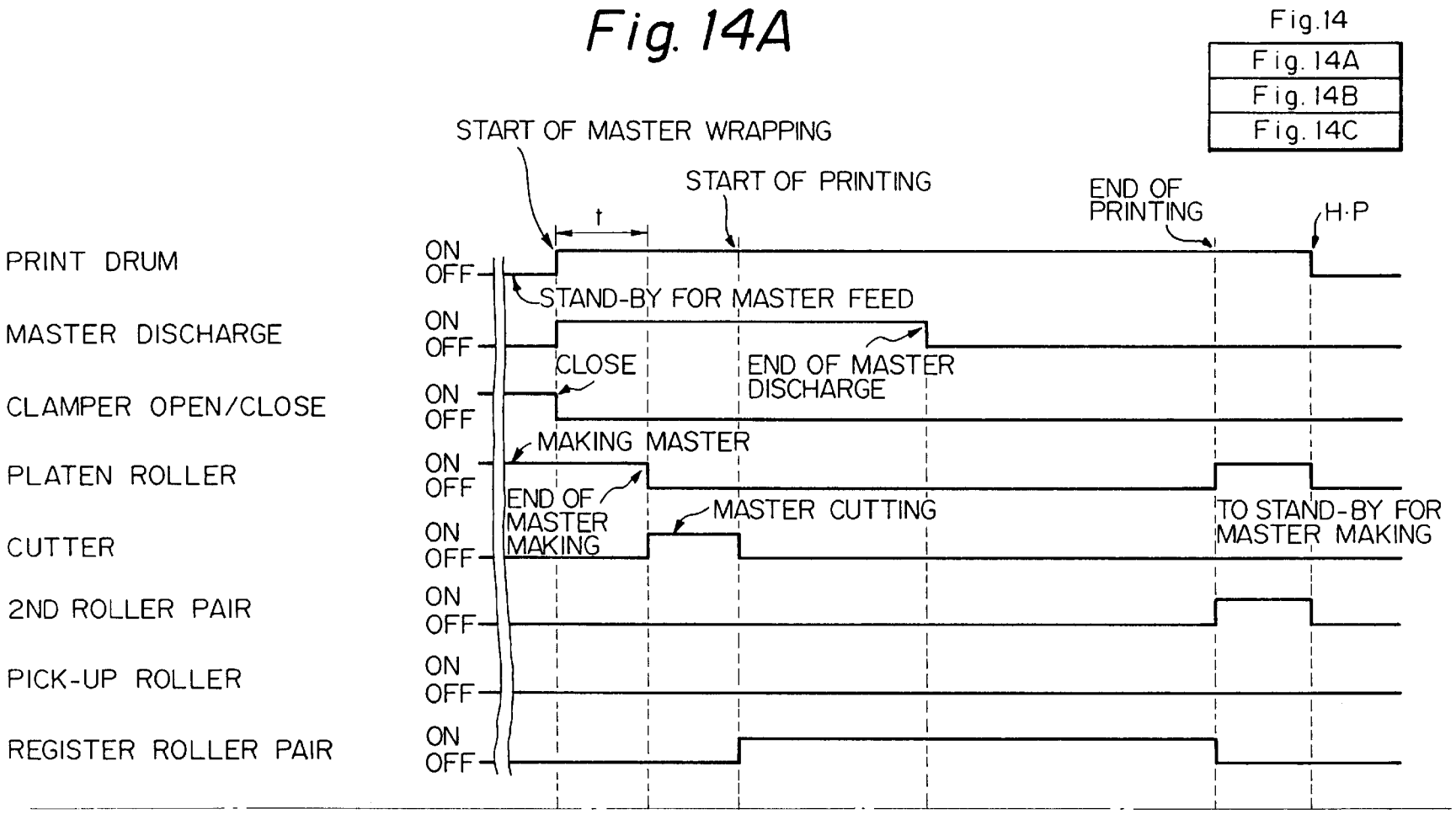
FIG. 14 is a timing chart demonstrating three different cases supplementing the description of the first specific operation.
Figure 14B:
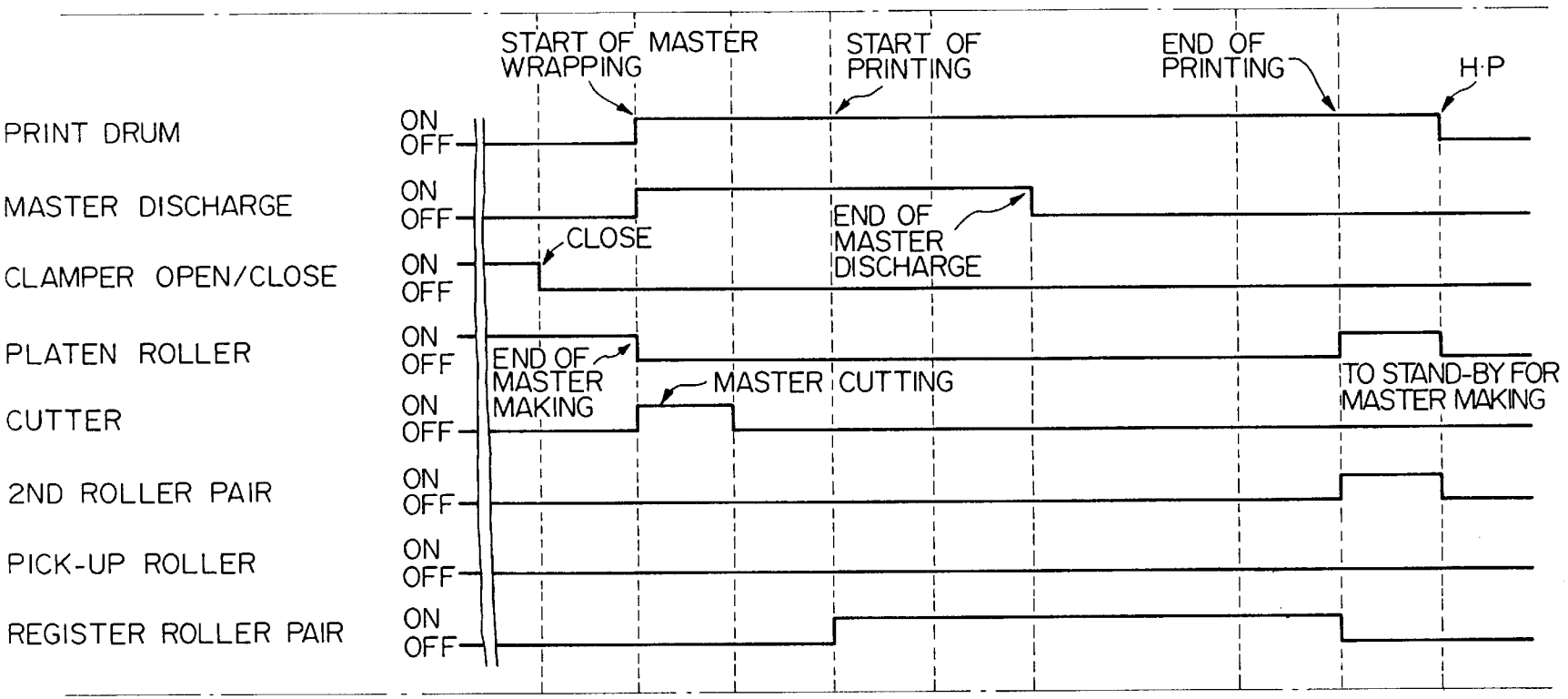
Figure 14C:
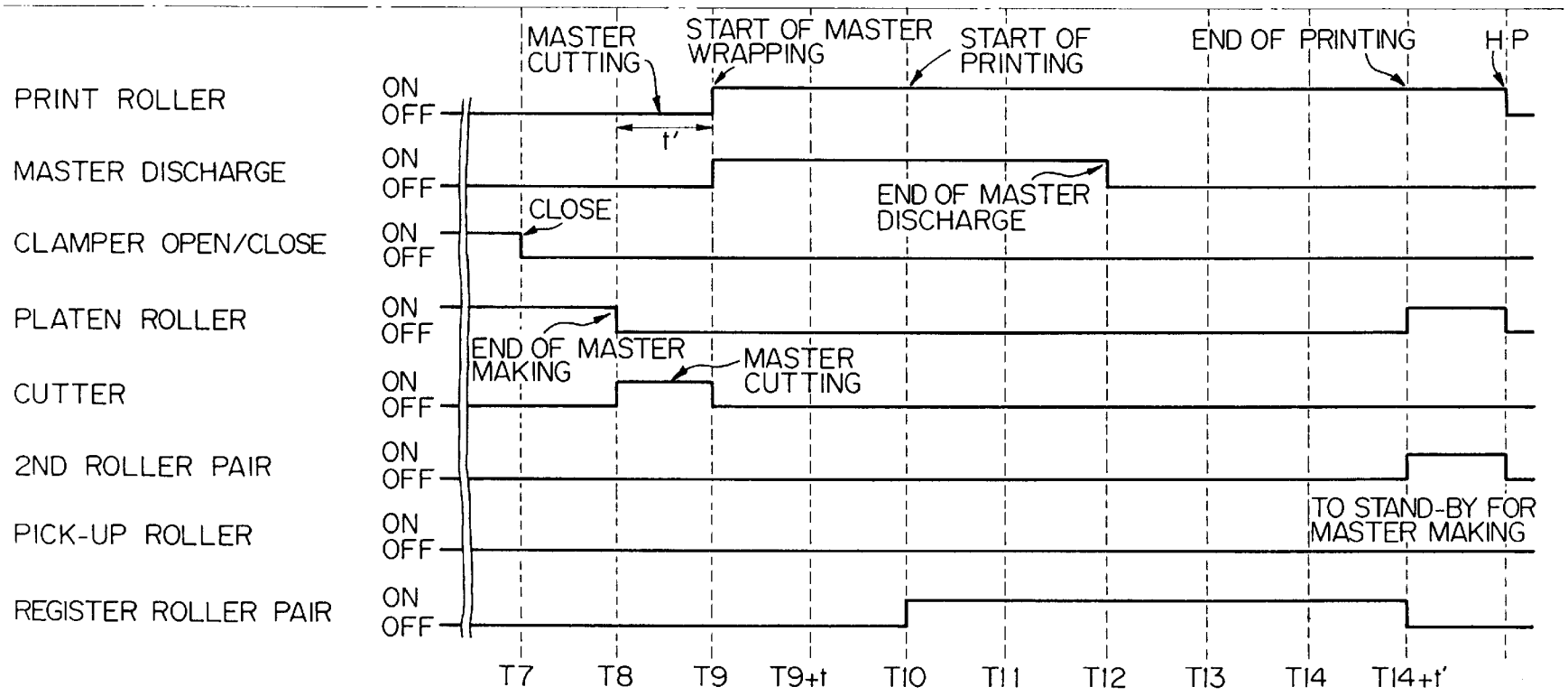

The advantage particular to the first specific operation will be described with reference to FIG. 14. FIG. 14 shows, by presenting three different specific cases, that the FPT depends on the time when the stencil 22 begins to be wrapped around the drum 2.

Figure 12A:
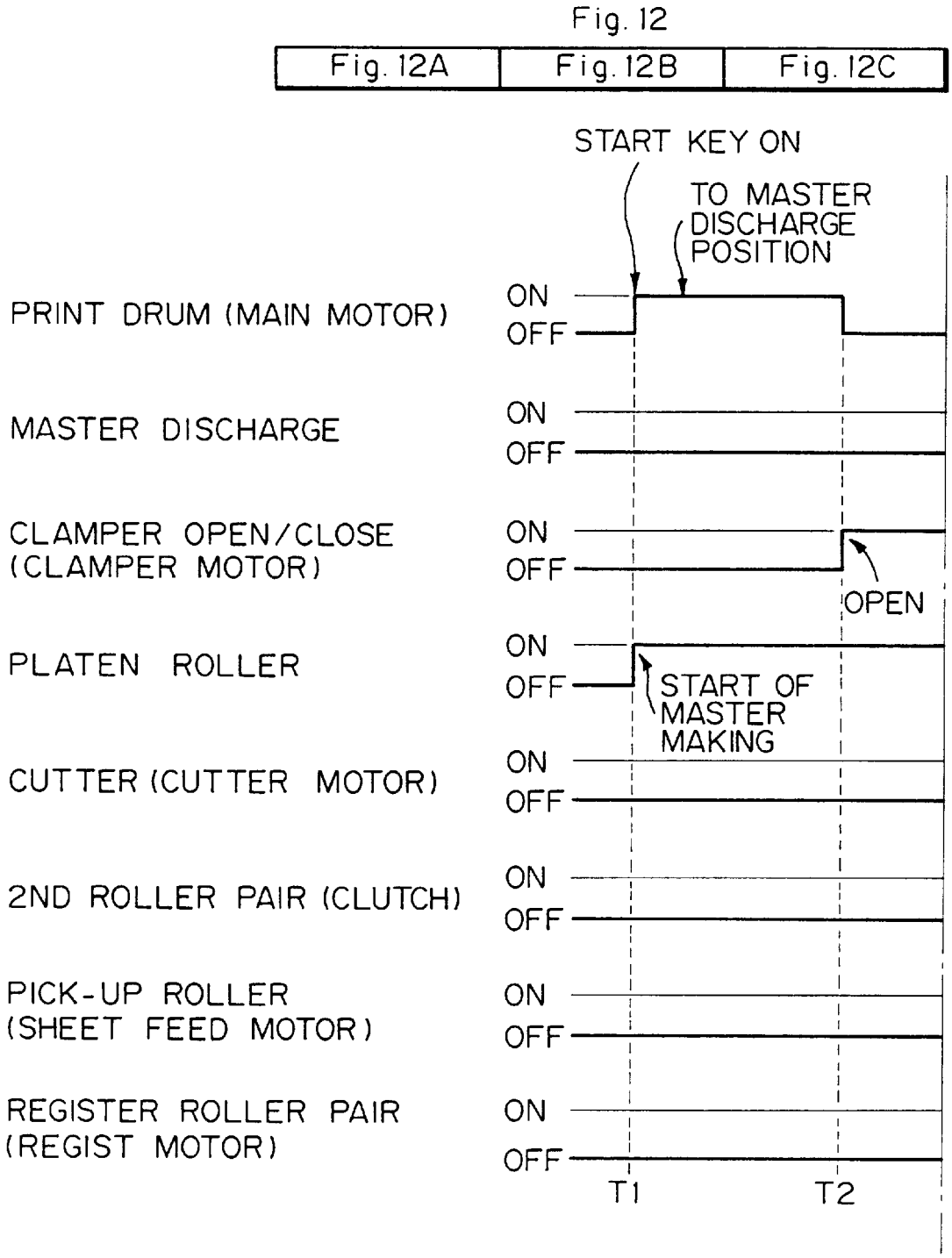
FIG. 12 is a timing chart demonstrating the first specific operation.
Figure 12B:
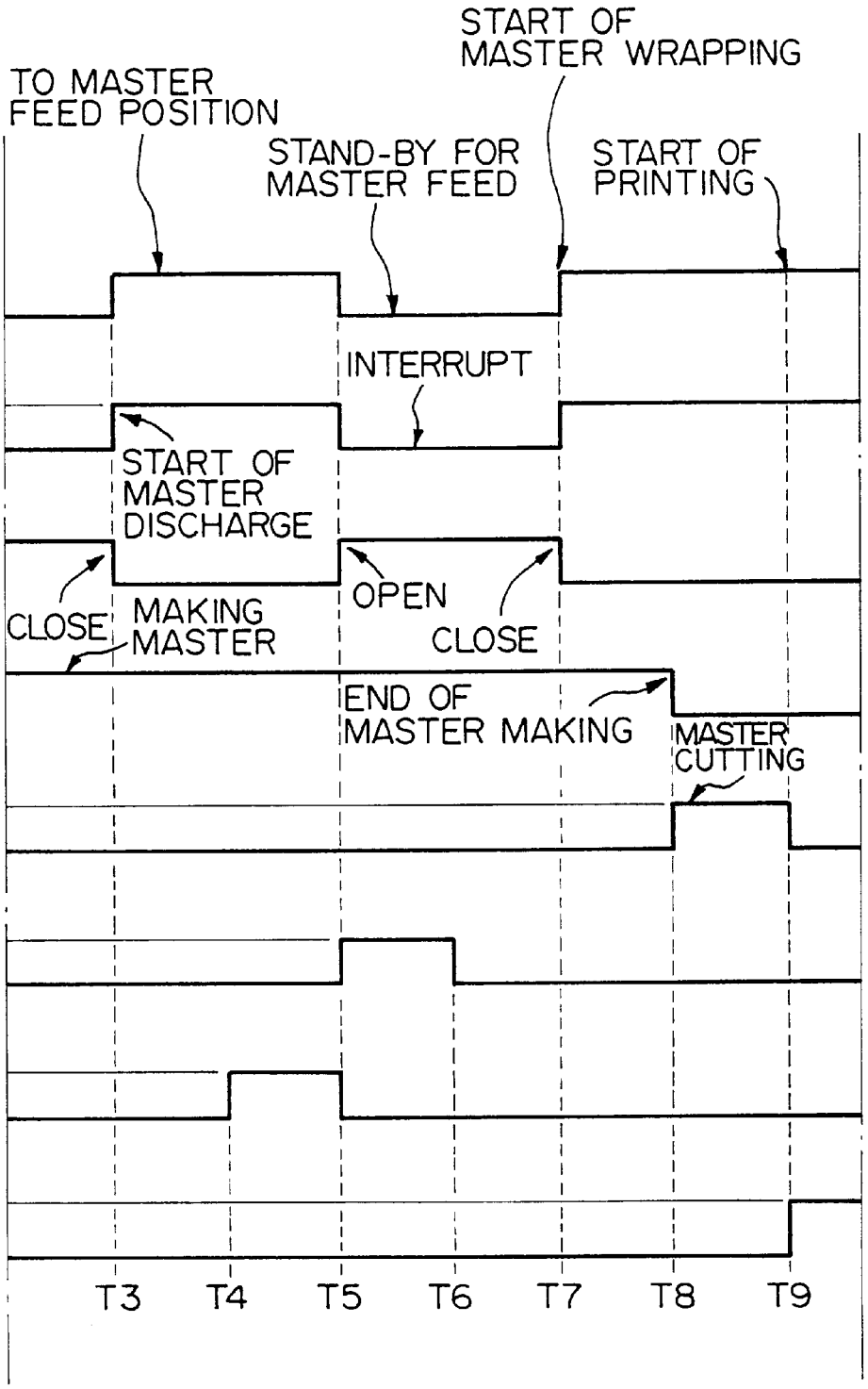
Figure 12C:
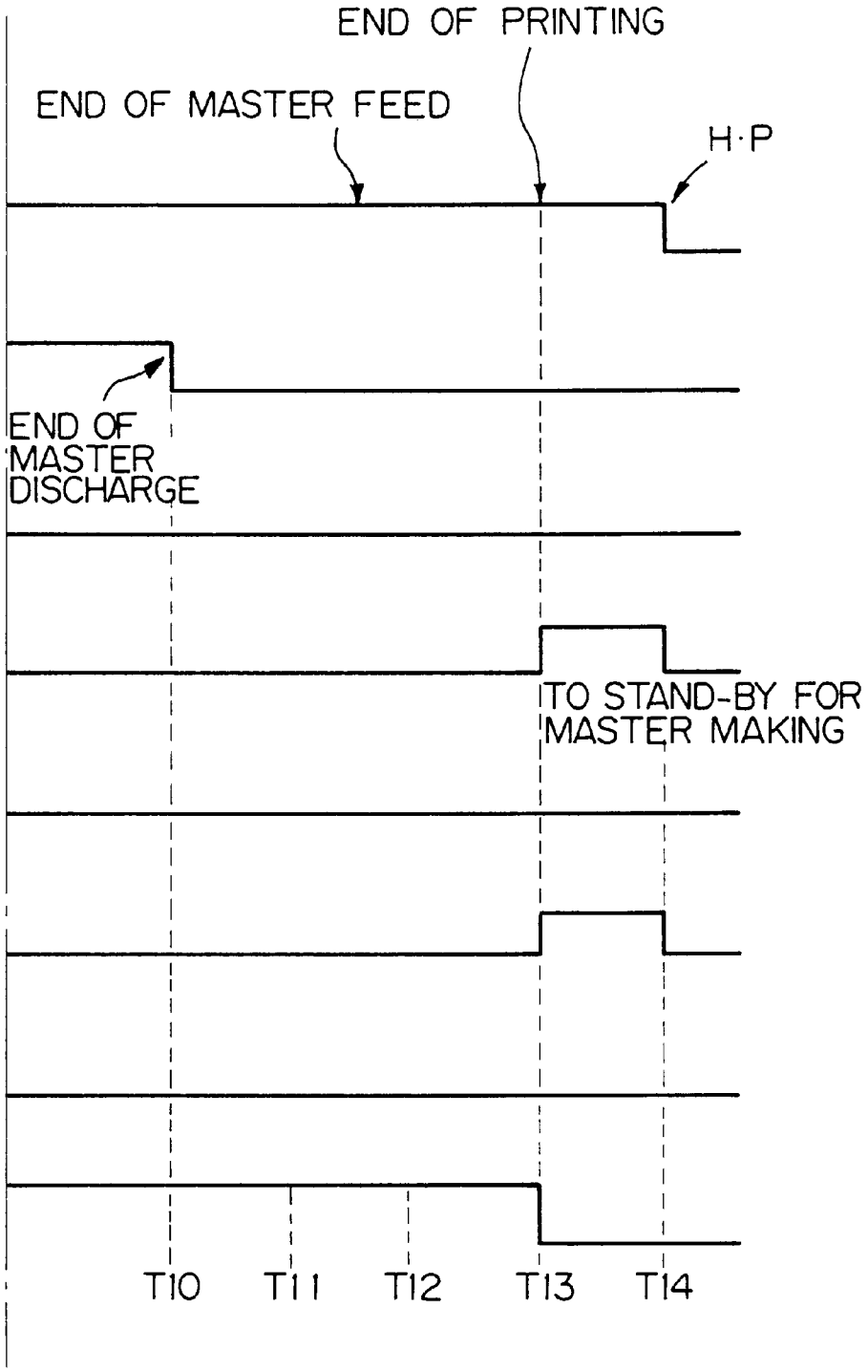

In FIG. 14, a top timing chart is representative of the part of the procedure of FIG. 12 following the master feed stand-by state between the time T5 and the time T7. Specifically, the top timing chart shows that the master wrapping operation begins t seconds before the time T8 when the master making operation ends, i.e., the master feeding operation occurs in parallel with the master making operation for t seconds while the printing operation ends at the time T13. A middle timing chart shows that the master wrapping operation begins at the time T8 when the master making operation ends, and that the printing operation ends at a time T14 t seconds later than the time T13 of the top timing chart. A bottom timing chart shows that the master wrapping operation begins t' seconds later than the time T8 when the master making operation ends, and that the printing operation ends at a time T14+t' which is t+t' seconds later than the time T13 of the top timing chart. It will be seen that the FPT is t seconds longer in the middle timing chart than in the top timing chart or even t+t' seconds longer in the bottom timing chart than in the top timing chart due to the difference in the start of the master wrapping operation.

As stated above, in the first specific operation, it is possible to produce the first printing in a short period of time, and therefore to further reduce the FPT. This is because the master feeding operation occurs while the master making operation is under way.

Second Specific Operation

Figure 15A:
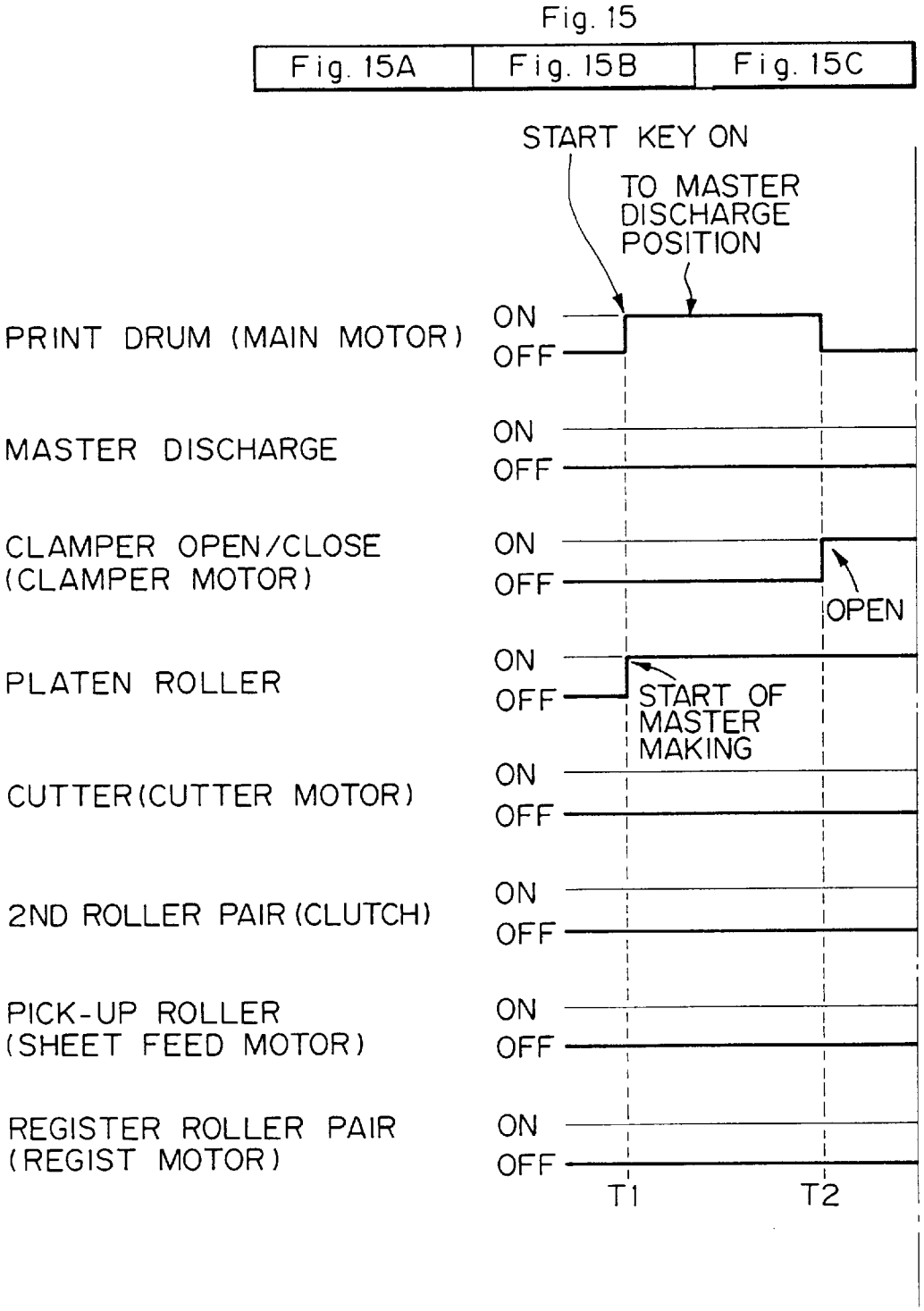
FIG. 15 is a timing chart representative of a second specific operation available with the printer shown in FIG. 1.
Figure 15B:
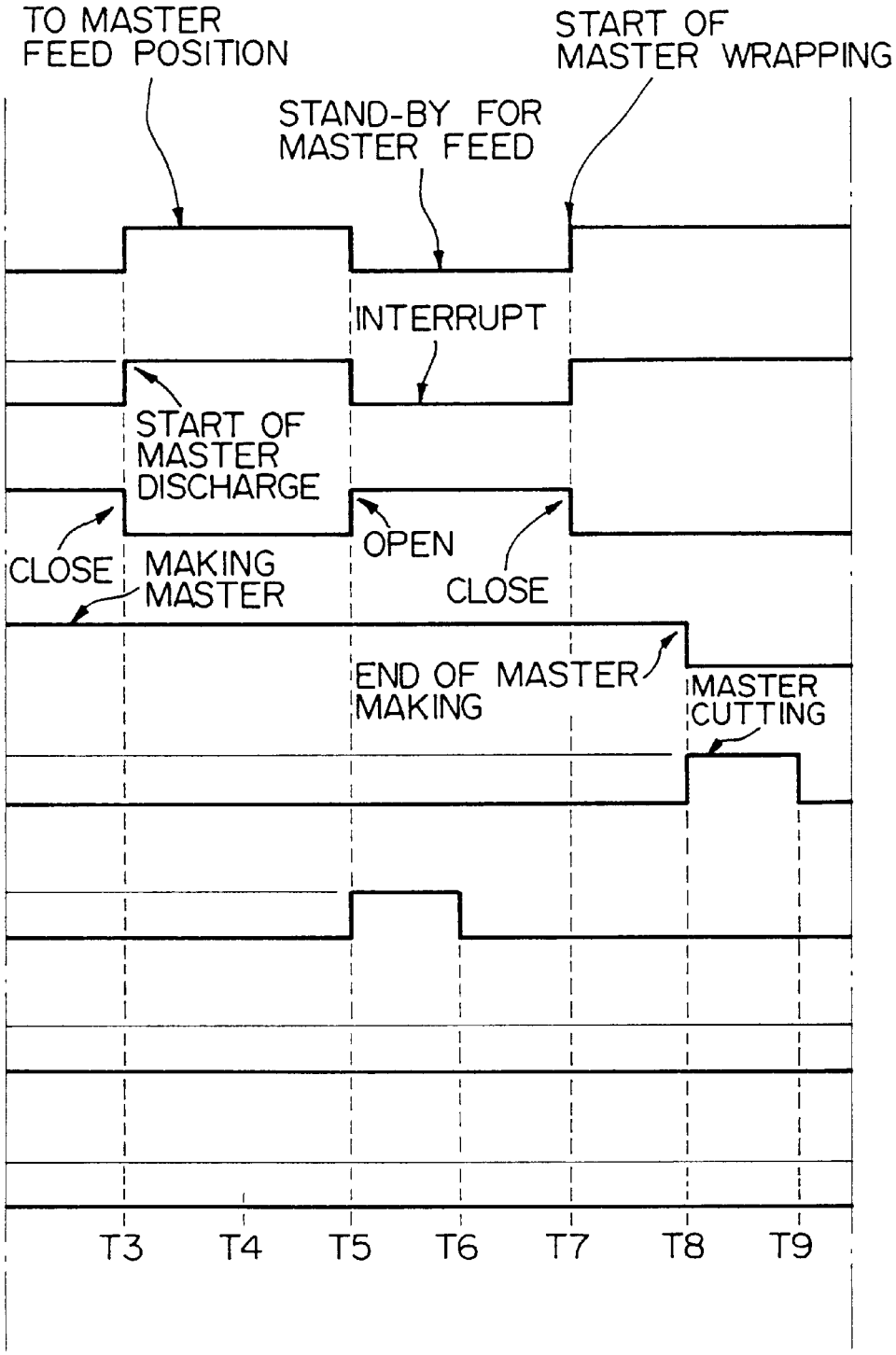
Figure 15C:
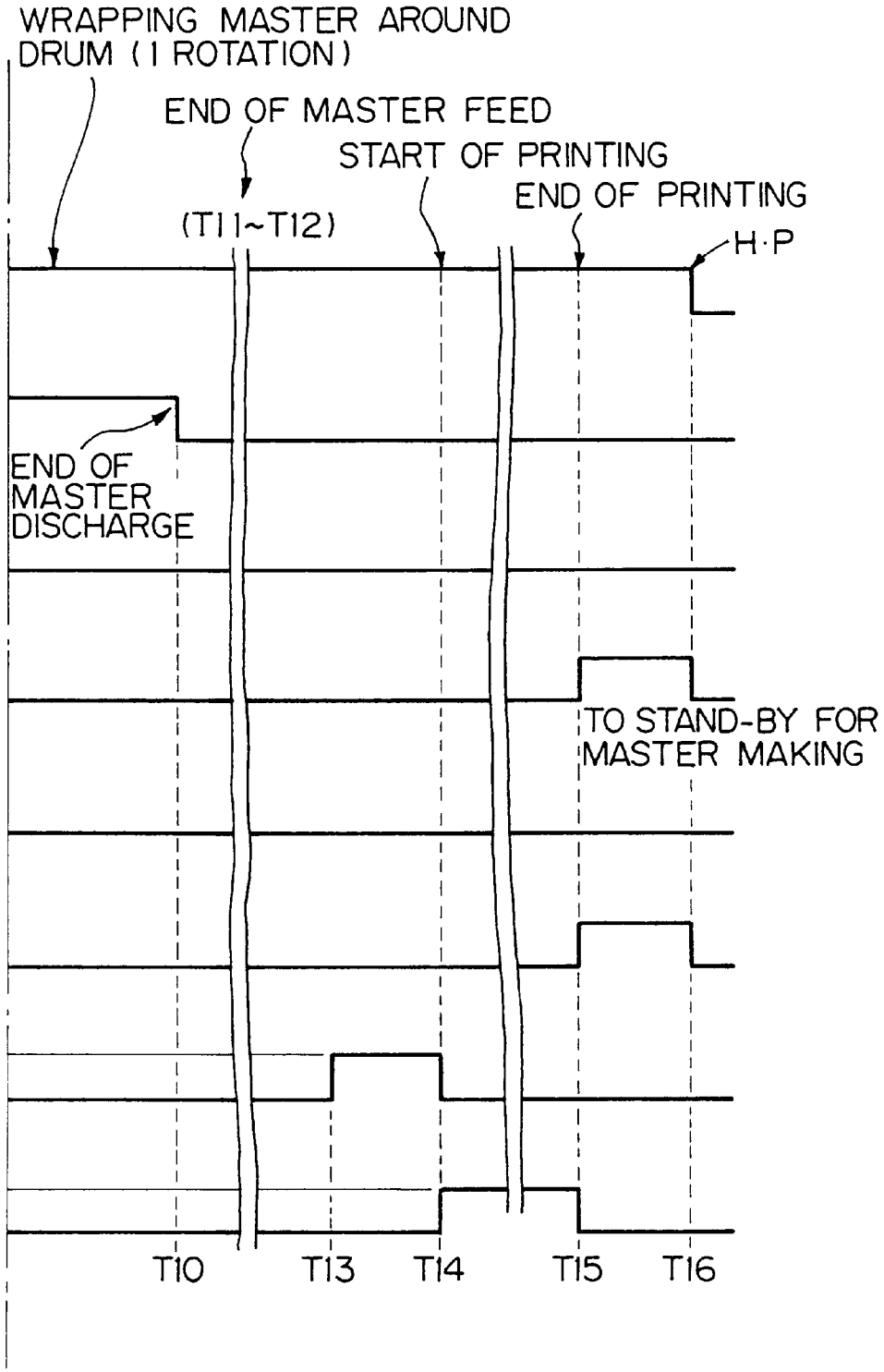
Figure 16:
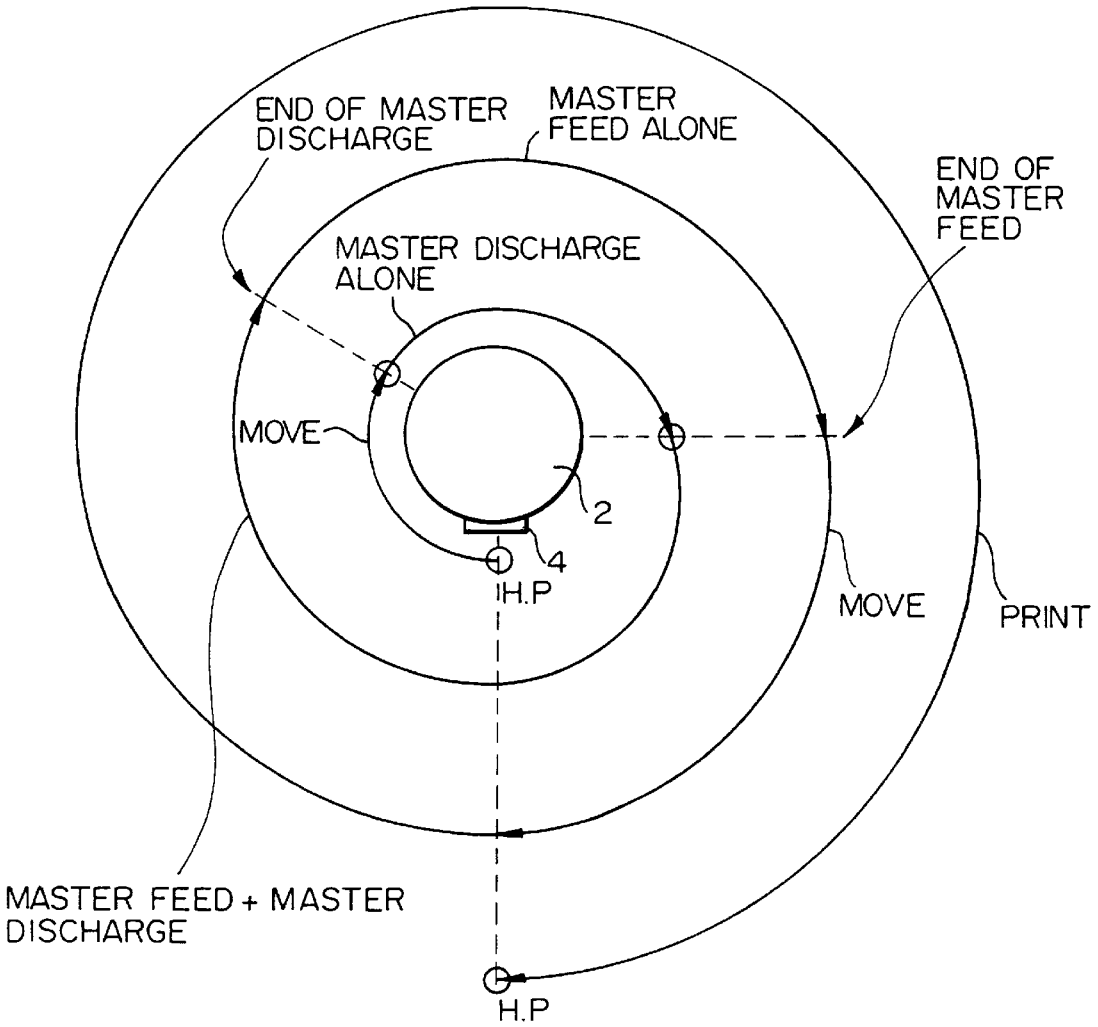
FIGS. 16 shows consecutive conditions occurring in the second specific operation and the number of rotations of the print drum.

Referring to FIGS. 15 and 16, there will be described a second specific operation, particularly differences thereof from the first specific operation. In the following description, a part of FIGS. 4–11 will sometimes be referenced.

In the second specific operation, the operator is again assumed to give priority to the reduction of the FPT. First, when the operator turns on the power switch of the printer 1, the high speed 1 mode lamp 99A turns on. Then, the operator desiring the high speed 2 mode presses the mode key 99 once. As a result, the high speed 2 mode lamp 99B turns on, showing that the high speed 2 mode is set up.

As shown in FIGS. 1, 4–8, 15 and 16, the master discharging section 50, document reading section 70 and master making section 20 operate in the same manner as in the first specific operation from the time T1 to the time T7. Specifically, the print drum 2 is moved from the home position to the master feed position (up to the master feed stand-by state) and again moved to the home position (second time). This is accompanied by the master discharging operation, the opening and closing of the master camper 4, and the master making operation. More specifically, the master discharging operation is interrupted at the time when the print drum 2 is brought to the master feed stand-by state for clamping the leading edge of the new master 22. After the print drum 2 has clamped the leading edge of the master 22, the first specific operation is repeated, except for the sheet feeding procedure, up to the time T7 when the master discharging operation is resumed in parallel with the master feeding operation.

From the time T7 to the time T8, the master feeding operation is effected while the master making operation is under way, as in the first specific operation. At the time T8, the master making operation ends in the same manner as in the conventional operation and first specific operation. During the interval between the time T8 and the time T9, the cutter 36 cuts the trailing edge of the master 22.

At the time T10 when the print drum 2 substantially arrives at the master discharge position again, the used master 22 is fully removed from the print drum 2 and discarded into the waste maser box 54. After the end of this master discharging operation, only the sheet feed operation is effected, as will be described with reference to FIG. 16.

In FIG. 16, when the print drum 2 substantially arrives at the master feed position, the single master 22 is fully wrapped around the drum 2. After the end of this master feeding operation, the sheet feeding operation begins at the time T13 in the same order and at the same intervals as in the conventional procedure (FIG. 24), so that the printing step and sheet discharging step are sequentially performed. Specifically, after the master feeding operation, ink is fed to the master 22 wrapped around the drum 2, printing the document image on the sheet S. More specifically, the registration roller pair 44 starts rotating at the time T14 in order to start the printing operation, and then stops at the time T15 for ending the printing operation. On the other hand, from the time T15 to the time T16, the leading edge of the next master 22 is brought to and held at the master make stand-by position shown in FIG. 1.

Subsequently, the operator sets a desired number of printings on the numeral keys 97 and again presses the start key 96. This causes the printer 1 to repeat the above operation the number of times corresponding to the desired number of printings.

As shown in FIGS. 15 and 16, in the second specific operation, the print drum 2 should only make three rotations from the time when the first printing is produced to the time when the drum 2 returns to its home position, reducing the FPT to T15–T1. Specifically, assuming that the print drum 2 has an outside diameter of 180 mm and rotates at a mean speed of 20 rpm, then the FPT (T15–T1) is only about 15 seconds which is about 3 seconds shorter than the conventional FPT.

Third Specific Operation

A third specific operation will be outlined. In this operation, the operator is also assumed to give priority to the reduction of the FPT. First, when the operator turns on the power switch of the printer 1, the high speed 1 mode lamp 99A turns on. Then, the operator desiring the high speed 3 mode presses the mode key 99 twice. As a result, the high speed 3 mode lamp 99C turns on, showing that the high speed 3 mode is set up.

Figure 17:
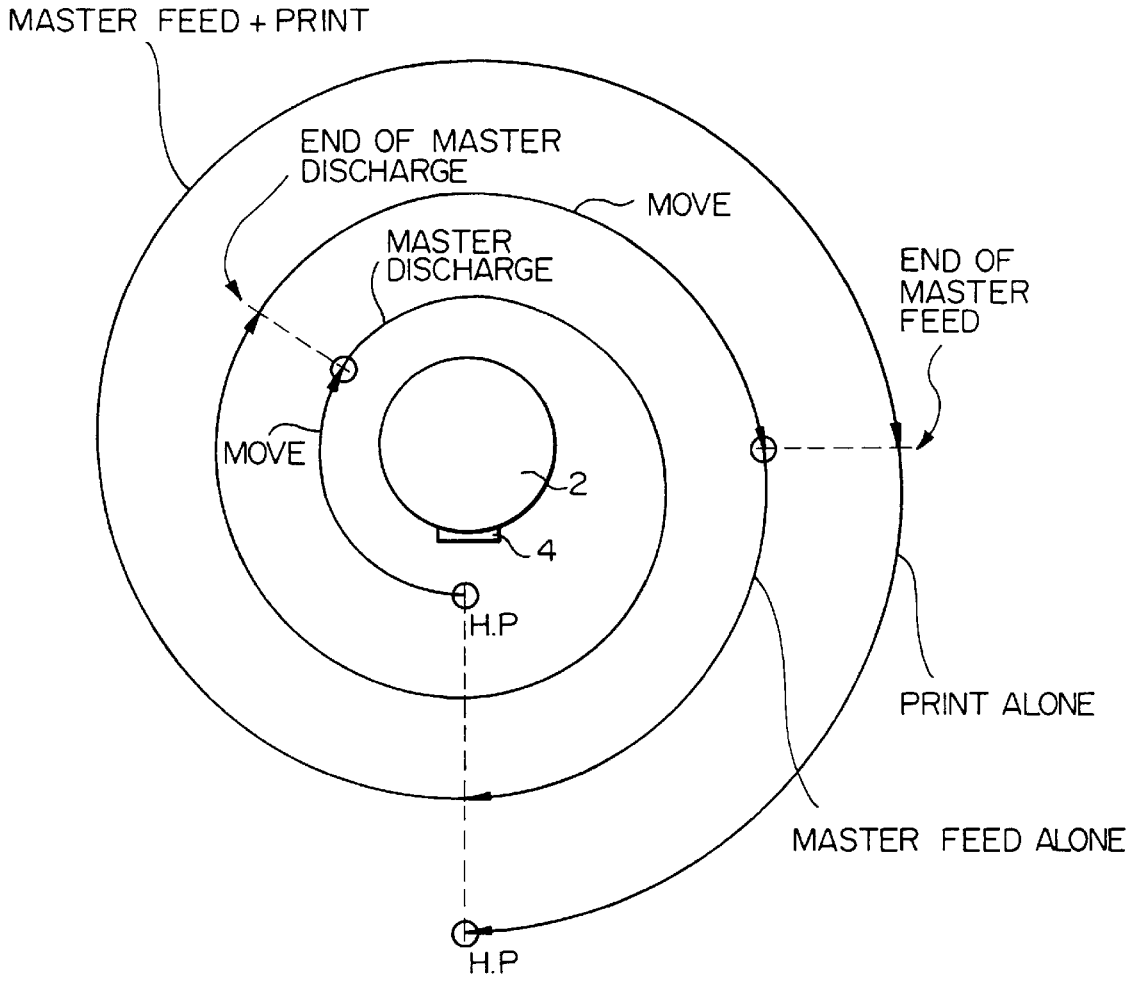
FIG. 17 shows consecutive conditions occurring in a third specific operation and associated with the rotation of the print drum and the stop of the rotation, and the number of rotations of the drum.

As shown in FIG. 17, the master discharging operation is effected up to its end in the same manner as in the conventional procedure, i.e., the low speed mode. After the master discharging operation, the printing operation is effected in parallel with the master feeding operation, as in the first specific operation pertaining to the high speed 1 mode. A timing chart representative of this specific operation is not shown because it will be readily understood on the analogy of the conventional procedure and the previous specific operations.

In this specific operation, the print drum 2 should only make three rotations from the time when the first printing is produced to the time when the drum 2 returns to its home position. This successfully reduces the FPT, compared to the conventional procedure.

Fourth Specific Operation

A fourth specific operation is identical with the conventional operation effected in the low speed mode. In this specific operation, the operator is assumed to give priority rather to image quality than to the reduction of the FPT. First, when the operator turns on the power switch of the printer 1, the high speed 1 mode lamp 99A turns on. Then, the operator desiring the low speed mode presses the mode key 99 three times. As a result, the low speed mode lamp 99D turns on, showing that the low speed mode is set up.

As stated above, the illustrative embodiment is capable of reducing the FPT without changing hardly any part of the conventional printer (1,000) except for a part of the main control unit 90 and operation panel 95. In addition, the operator can select desired one of the four different modes matching with the desired purpose or application simply by pressing the mode key 99. The printer 1 is therefore extremely easy and convenient to use.

Figure 18:
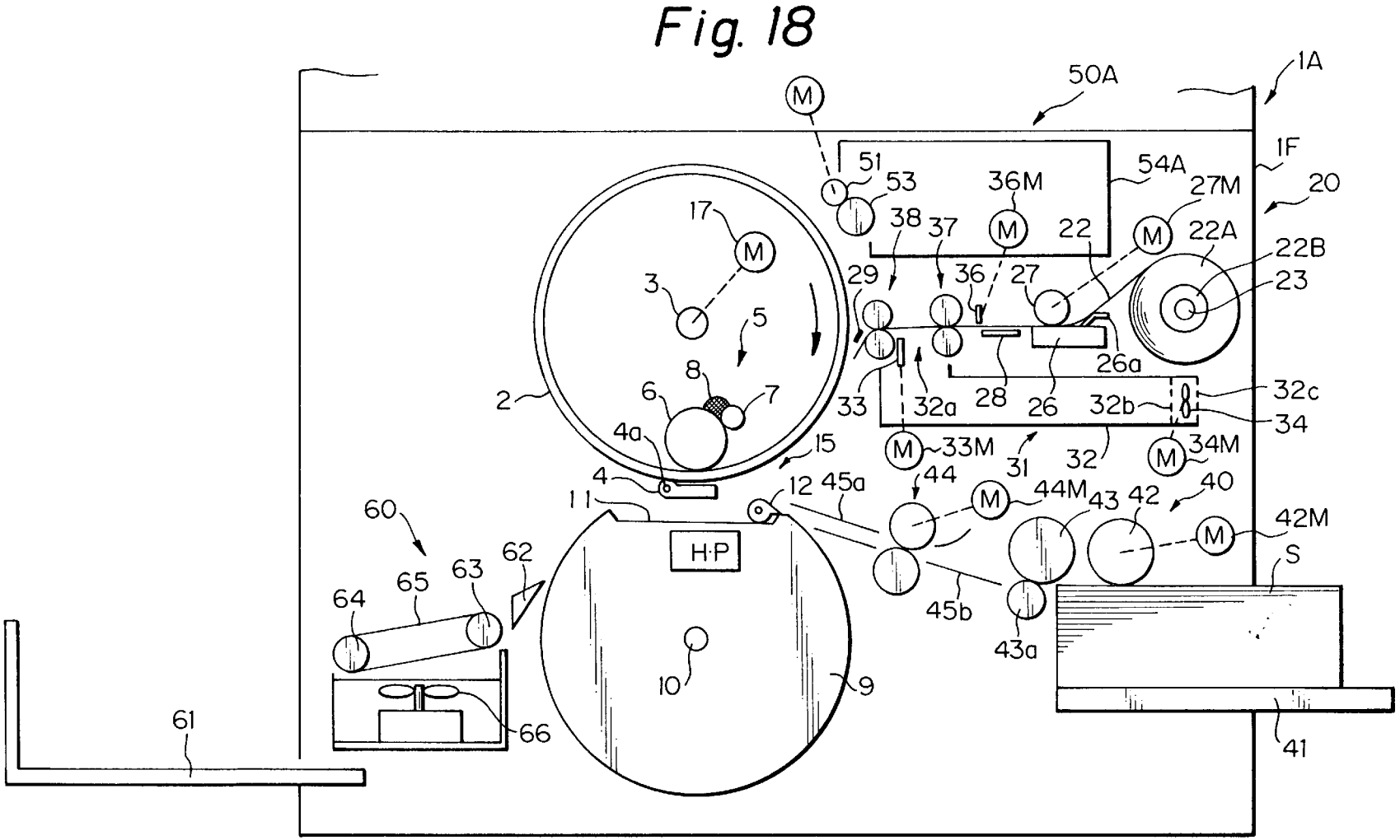
FIG. 18 is a fragmentary front view showing an alternative embodiment of the present invention.

Referring to FIG. 18, an alternative embodiment of the present invention will be described. The following description will concentrate on the differences between the previous embodiment and the alternative embodiment. In FIG. 18, the document reading section 70 and other sections not necessary for the understanding of the alternative embodiment are not shown.

As shown in FIG. 18, a stencil printer, generally 1A, differs from the printer 1 mainly in that a master discharging section 50A is substituted for the master discharging section 50, and in that the section 50A is positioned in the vicinity the master making section 20 and upstream of the same with respect to the direction of rotation of the print drum 2. In this condition, the master discharge position is one where the master clamper 4 of the print drum 4 is located below, but in the vicinity of, the discharge roller 53. Also, the master feed position is one where the master clamper 4 is located below, but in the vicinity of, the second roller pair 38. Although the master feed position sensor 14 is located at a different position, its essential configuration and function are the same. This is why the same reference numeral is used to designate the sensor.

The master discharging section 50A differs from the master discharging section 50 only in that a horizontally long waster master box 54A is substituted for the vertically long box 54 for a layout reason, and in that the peel roller 51 and discharge roller 53 are replaced in position in the up-and-down direction. The master discharge drive 56 is essentially common to both the master discharging sections 50 and 50A and therefore designated by the same reference numeral.

Reference will be made to FIGS. 18–22 for describing the operation of the illustrative embodiment (referred to as a fifth specific operation in distinction from the first to fourth specific operations). The fifth specific operation is similar to the first specific operation except for the following.

As shown in FIG. 18, in the initial condition of the printer 1A, the leading edge of the stencil 22 paid out from the roll 22A is nipped by the second roller pair 38 and held at the master make stand-by position. The print drum 2 is held at its home position. The operator stacks the documents 73 on the feed tray 72 of the document reading section 70, and if the sheets S are absent on the sheet tray 41, replenishes sheets, as in the first specific operation.

Figure 19:
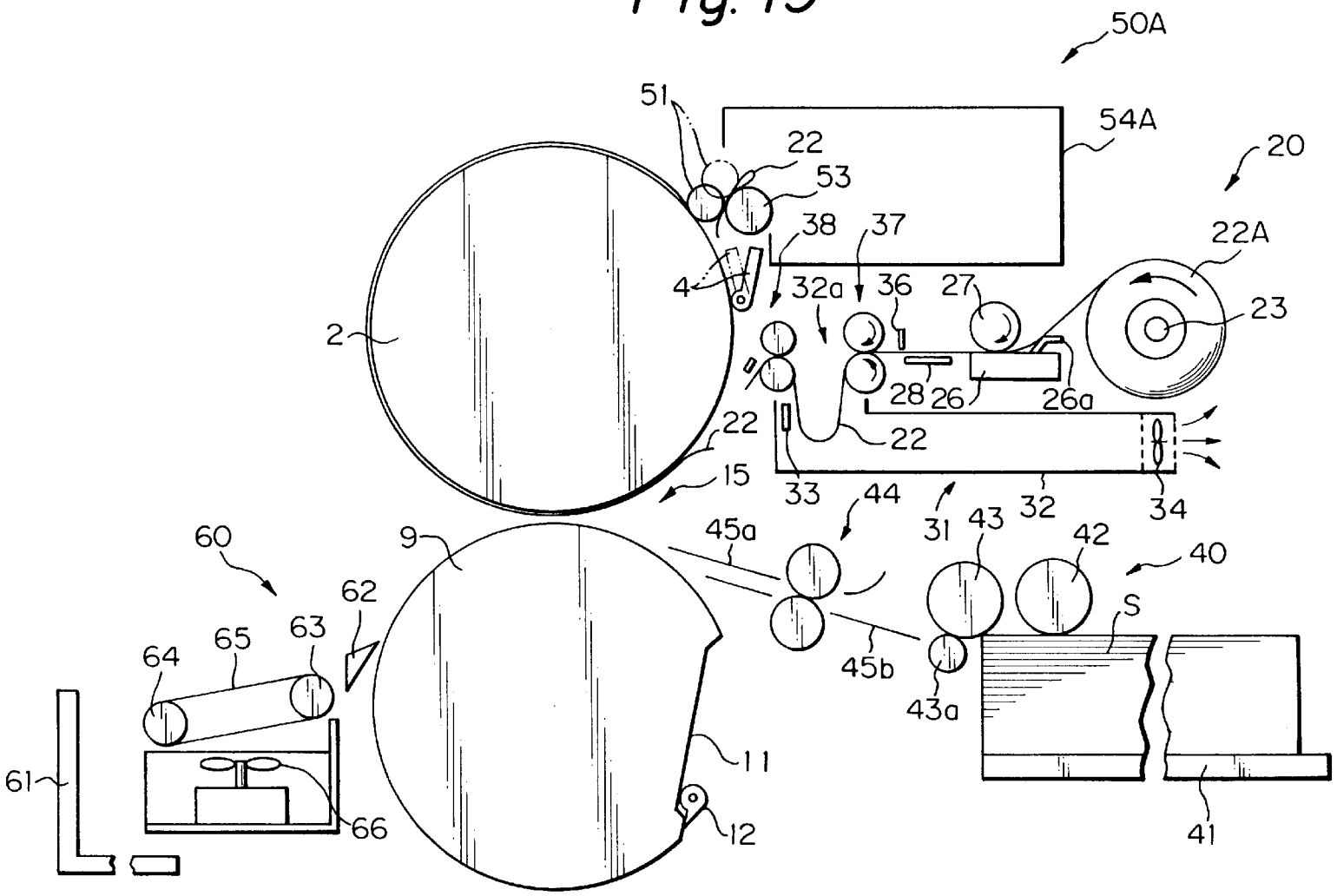
FIGS. 19–22 are fragmentary front views showing the alternative embodiment in a sequence of steps constituting a fifth specific operation.
Figure 20:
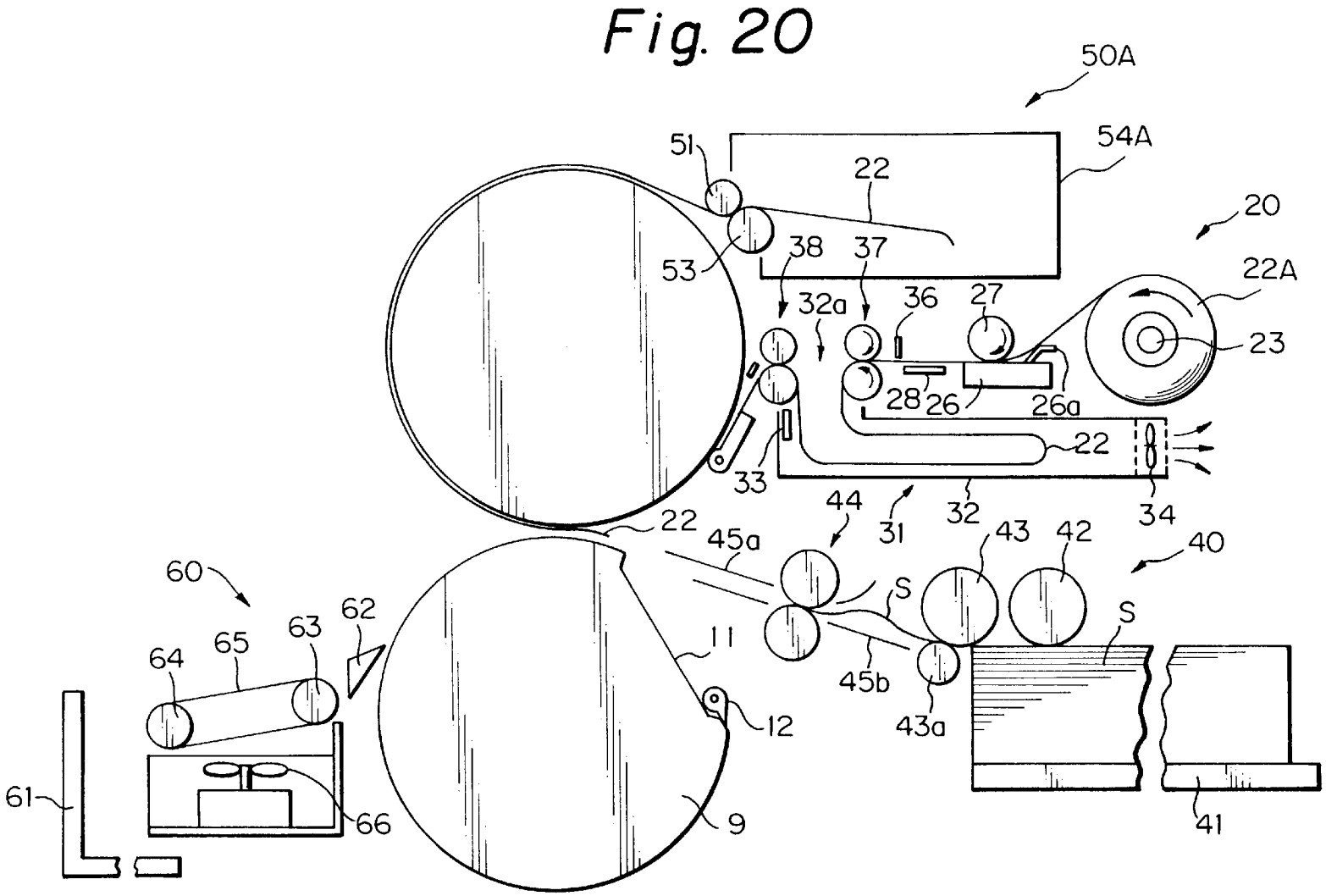

Subsequently, when the operator turns on the power switch of the printer 1A, the high speed 1 mode is automatically set, as in the first specific operation. Subsequently, when the operator presses the start key 96, the print drum 2 is rotated counterclockwise from the home position to the master discharge position and stopped there, as shown in FIG. 19. The opening and closing of the master clamper 4 at the master discharge position, the removal of the used master 22 from the print drum 2, and the master making operation are effected in substantially the same manner as in the first specific operation. As shown in FIGS. 19 and 20, while the print drum is in clockwise rotation, the peel roller 51 and discharge roller 53 sequentially peel off the used master 22. As a result, the used master 22 is peeled off by an amount corresponding to the angular movement o the print drum 2 and discarded into the waste master box 54A.

As shown in FIG. 20, the print drum 2 is brought to and stopped at the master feed position. Just after the stop of the print drum 2, the master clamper 4 is opened. In this condition, the print drum 2 waits for the new master 22. In the master making section 20, the stencil 22 is continuously perforated while being caused to warp by the master stocking means 31. The second roller pair 38 in rotation conveys the leading edge of the perforated part of the stencil 22 toward the master clamper 4 along the second guide plate 29. When the leading edge of the above part of the stencil 22 reaches the master clamper 4, as determined in terms of the number of steps of the platen motor 27M, the operation of the second roller pair 38 is interrupted. In this condition, the master clamper 4 is closed and clamps the leading edge of the stencil 22. While the print drum 2 is held in the above master feed stand-by state, the master discharging operation of the master discharge drive 56 is interrupted.

On the other hand, when the master making operation is under way and when the print drum 2 is moving toward the master feed position, the leading edge of the sheet S is caused to abut against the nip of the registration roller pair 44 included in the sheet feeding section 40. As a result, the sheet S has its leading edge held by the nip of the roller pair 44 and has its trailing edge held by the pick-up roller and separator roller pair 43.

Figure 21:
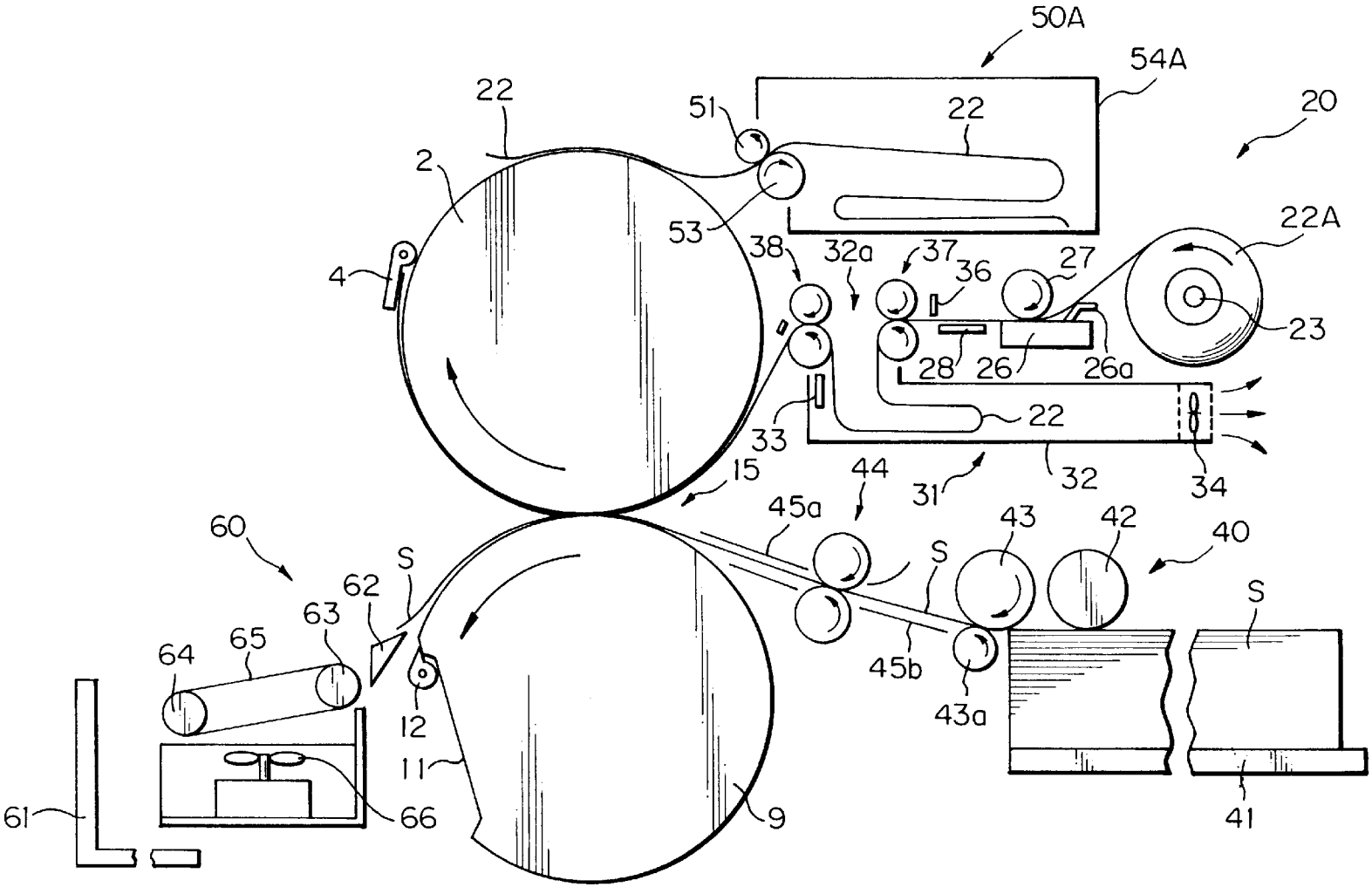

The print drum 2 is rotated clockwise at the same time as the master clamper 22 clamps the leading edge of the master 22, as shown in FIG. 21. As a result, the master feeding operation is effected in the same manner as in the first specific operation. The master discharging section 50A performs the master discharging operation in parallel with the master feeding operation. In the printing section 15, the sheet feeding operation begins in parallel with the master feeding operation and master discharging operation and in synchronism with the rotation of the print drum 2 to its home position, as in the first specific operation. This is followed by the printing operation and sheet discharging operation described in relation to the first specific embodiment.

Assume that the main control unit 90 determines, based on the number of steps of the platen motor 27M, that the stencil 22 has been perforated over a length corresponding to a single master. Then, the platen roller 27, first roller pair 37 and suction fan 34 are caused to stop rotating, completing the master making operation. Subsequently, the cutter 36 cuts the trailing edge of the perforated part of the stencil 22, as in the first specific operation.

Figure 22:
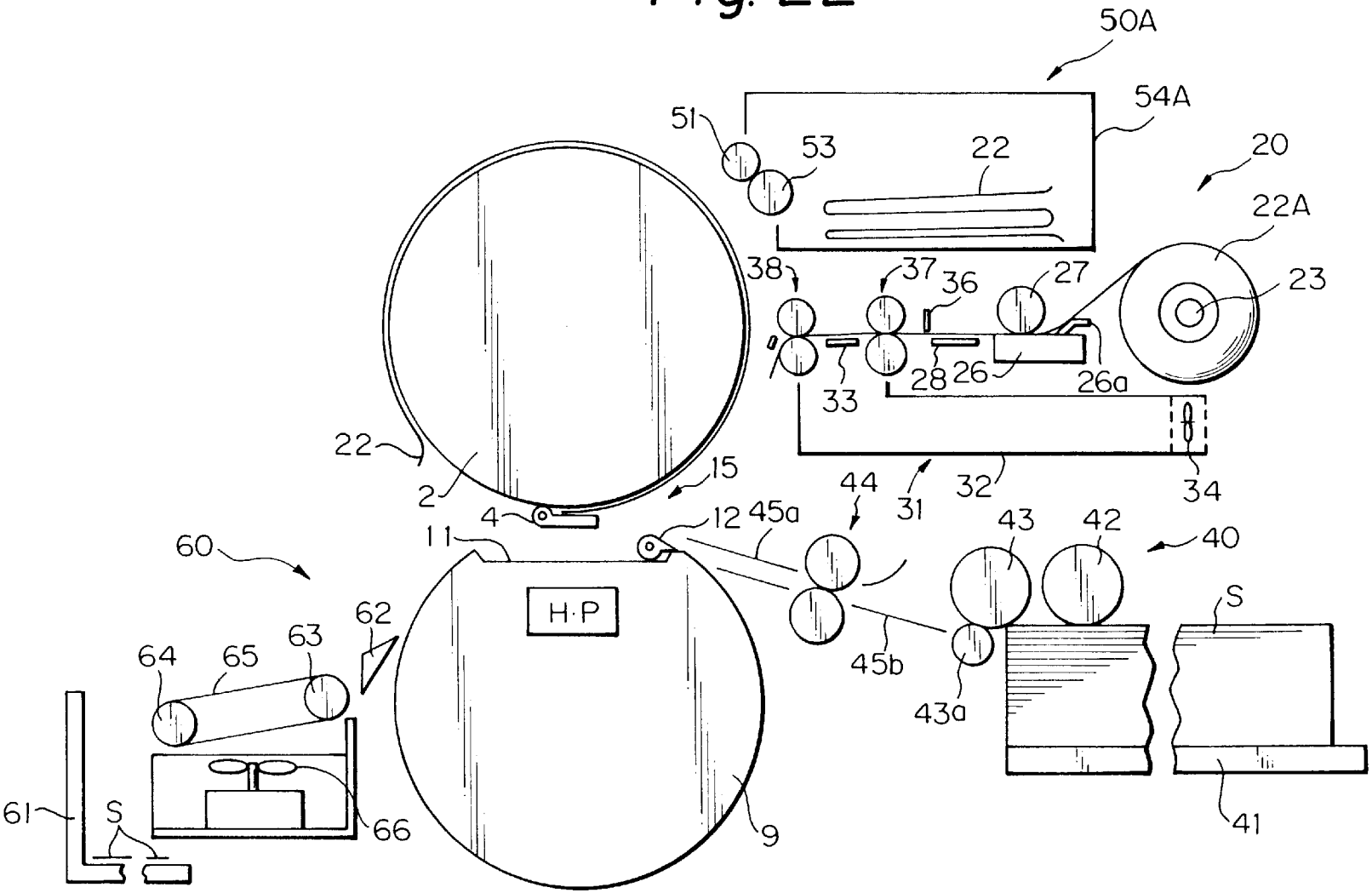

On the other hand, as shown in FIGS. 21 and 22, the master discharging section 50A continues the master discharging operation until the print drum 2 again arrives at a position just short of the master discharge position. As a result, the used master 22 is fully removed from the print drum 2. At the end of the master discharging operation, the printing section 15 is performing the printing operation and sheet discharging operation, as stated previously.

When the print drum 2 reaches the master feed position, the single master 22 is fully wrapped around the drum 2. This is the end of the master feeding operation. Subsequently, the printed sheet S is driven out onto the printing tray 61 as a trial printing. Thereafter, the print drum 2 is rotated to and stopped at the home position.

When the printing operation ends, the guide 33 included in the master making section 20 is moved from the warp position to the guide position, as in the first specific operation. At the same time, the platen roller 27 and first and second roller pairs 37 and 38 are rotated, conveying the leading edge of the next master 22 cut off by the cutter 36 to the master make stand-by position shown in FIG. 22. Then, the platen roller 27 and first and second roller pairs 37 and 38 are caused to stop rotating.

After the production of the trial printing, the operator sets a desired number of printings on the numeral keys 97 and again presses the start key 96, as in the first specific operation. This causes the printer 1A to repeat the sheet feeding operation, printing operation and sheet discharging operation the number of times corresponding to the desired number of printings.

The fifth specific operation stated above noticeably reduces the distance between the master discharge position and the master feed position of the print drum 2, compared to the first specific operation. Therefore, the print drum 2 should only make two and some rotations from the time when the first printing is produced to the time when the drum 2 returns to the home position. The resulting FPT is even shorter than the FPT achievable with the first specific operation. This can be done only if a part of the main control unit 90 and operation panel 95 is omitted and if the position of the master making section 50 of the previous embodiment is changed. In addition, because the sheet S is fed to the registration roller pair 44 beforehand while the master making operation is under way, there can be implemented higher registration accuracy and lower noise at the time of sheet feed.

While only the fifth specific operation has been shown and described in relation to this embodiment, this embodiment is, of course, operable in the high speed 2 mode, high speed 3 mode and low speed mode in the same manner as in the second to fourth specific operations of the previous embodiment.

In summary, it will be seen that the present invention provides a stencil printing method and a printer using the same which have various unprecedented advantages, as enumerated below.

(1) An operation for discharging a used master and an operation for feeding a new master are effected in parallel in order to reduce the required amount of rotation of a print drum and therefore the FPT.

(2) The master feeding operation and a printing operation are effected in parallel in order to reduce the FPT.

(3) The master discharging operation and master feeding operation are effected in parallel, and the master feeding operation and printing operation are effected in parallel. This further reduces the FPT.

(4) The master feeding operation is effected while a master making operation is under way. This additionally reduces the FPT.

(5) While the master making operation is under way, a sheet is fed beforehand to sheet transport synchronizing means which conveys the sheet in synchronism with the new master. This implements higher registration accuracy and lower noise at the time of sheet feed during the printing operation.

(6) With the printer using the above various printing methods, it is possible to further reduce the FPT without changing a conventional stencil printer except for a few units including a control unit.

(7) A master discharging section is located in the vicinity of and upstream of a master making section with respect to the direction of rotation of the print drum. This further reduces the required amount of rotation of the print drum and therefore the FPT.

Various modifications will become possible for those skilled in the art after receiving the teachings of the present disclosure without departing from the scope thereof. For example, the control means 90 may be so configured as to cause the printer 1 or 1A to operate in only one of the high speed 1 mode, high speed 2 mode, high speed 3 mode, and low speed mode. Alternatively, the high speed 1 mode through the low speed mode may be implemented in any suitable combination.

While the first and second electromagnetic clutches 27C and 38C are respectively assigned to the platen roller 27 and second roller pair 38, only a single platen motor and the second clutch 38C may, of course, be combined. Further, the platen roller 27 and second roller pair 38 may each be driven by a respective control motor although the number of drive means will increase.

The printer 1 or 1A may be provided with a construction taught in, e.g., Japanese Patent Laid-Open Publication No. 7-17013 and in which ink is fed from the outside of a print drum to a master wrapped around the drum. If desired, the first to fifth specific operations may be suitably combined.

What is claimed is:

1. A stencil printing method including a master discharging operation for peeling a used master off a print drum and discharging said used master, a master making operation for making a new master in accordance with an image signal representative of a document image, a master feeding operation for wrapping said new master around said print drum while clamping a leading edge of said new master on said print drum, and a printing operation for feeding ink to said new master wrapped around said print drum to thereby print the document image on a sheet, said stencil printing method comprising the steps of:

interrupting, while said master discharging operation is under way, said master discharging operation when said print drum reaches a stand-by position for awaiting said new master;

resuming, after the leading edge of said new master has been clamped on said print drum during said master feeding operation, said master discharging operation while effecting said master feeding operation; and effecting said printing operation after said master feeding operation.

2. A method as claimed in claim 1, further comprising:

effecting said master feeding operation while said master making operation is under way.

3. A method as claimed in claim 2, further comprising:

feeding the sheet to sheet transport synchronizing means for conveying the sheet in synchronism with the new master wrapped around said print drum while said master making operation is underway.

4. A method as claimed in claim 1, further comprising:

feeding the sheet to sheet transport synchronizing means for conveying the sheet in synchronism with the new master wrapped around said print drum while said master making operation is underway.

5. A printer comprising:

a print drum;

a master discharging section for peeling a used master off a print drum and discharging said used master;

a master making section for making a new master in accordance with an image signal representative of a document image;

a master feeding section for wrapping said new master around said print drum while clamping a leading edge of said new master on said print drum;

a printing section for feeding ink to said new master wrapped around said print drum to thereby print the document image on a sheet; and a control unit configured to control the printer such that while a master discharging operation of said master discharging section is under way, said master discharging operation is interrupted when said print drum reaches a stand-by position for awaiting said new master, wherein after the leading edge of said new master has been clamped on said print drum during said master feeding operation, said master discharging operation is resumed during said master feeding operation, and wherein a printing operation of said printing section is effected after said master feeding operation.

6. A printer as claimed in claim 5, wherein said master discharging section is located in the vicinity of said master making section and upstream of said master making section in a direction of rotation of said print drum.

7. A stencil printing method including a master discharging operation for peeling a used master off a print drum and discharging said used master, a master making operation for making a new master in accordance with an image signal representative of a document image, a master feeding operation for wrapping said new master around said print drum while clamping a leading edge of said new master on said print drum, and a printing operation for feeding ink to said new master wrapped around said print drum to thereby print the document image on a sheet, said method comprising the step of:

feeding ink to said new master wrapped around said print drum to print the document image on the sheet after said master discharging operation; and wrapping said new master around said print drum during said feeding step while clamping a leading edge of said new master on said print drum by initiating said master feeding operation.

8. A method as claimed in claim 7, further comprising:

effecting said master feeding operation while said master making operation is under way.

9. A method as claimed in claim 8, further comprising:

feeding the sheet to sheet transport synchronizing means for conveying the sheet in synchronism with said new master wrapped around said print drum while said master making operation is underway.

10. A method as claimed in claim 6, further comprising:

feeding the sheet to sheet transport synchronizing means for conveying the sheet in synchronism with said new master wrapped around said print drum while said master making operation is underway.

11. A printer comprising:

a print drum;

a master discharging section for peeling a used master off a print drum and discharging said used master;

a master making section for making a new master in accordance with an image signal representative of a document image;

a master feeding section for wrapping said new master around said print drum while clamping a leading edge of said new master on said print drum;

a printing section for feeding ink to said new master wrapped around said print drum to thereby print the document image on a sheet; and a control unit configured to control the printer such that after a master discharging operation of said master discharging section, a printing operation of said printing section is effected during a master feeding operation of said master feeding section.

12. A printer as claimed in claim 11, wherein said master discharging section is located in the vicinity of said master making section and upstream of said master making section in a direction of rotation of said print drum.

13. A stencil printing method including a master discharging operation for peeling a used master off a print drum and discharging said used master, a master making operation for making a new master in accordance with an image signal representative of a document image, a master feeding operation for wrapping said new master around said print drum while clamping a leading edge of said new master on said print drum, and a printing operation for feeding ink to said new master wrapped around said print drum to thereby print the document image on a sheet, said stencil printing method comprising the steps of:

interrupting, while said master discharging operation is under way, said master discharging operation when said print drum reaches a stand-by position for awaiting said new master; and resuming, after the leading edge of said new master has been clamped on said print drum during said master feeding operation, said master discharging operation while effecting said master feeding operation, and effecting said printing operation at the same time as resuming said master discharging operation.

14. A method as claimed in claim 11, further comprising:

effecting said master feeding operation while said master making operation is under way.

15. A method as claimed in claim 14, further comprising:

feeding the sheet to sheet transport synchronizing means for conveying the sheet in synchronism with said new master wrapped around said print drum while said master making operation is underway.

16. A method as claimed in claim 11, further comprising:

feeding the sheet to sheet transport synchronizing means for conveying the sheet in synchronism with said new master wrapped around said print drum while said master making operation is underway.

17. A printer comprising:

a master discharging section for peeling a used master off a print drum and discharging said used master;

a master making section for making a new master in accordance with an image signal representative of a document image;

a master feeding section for wrapping said new master around said print drum while clamping a leading edge of said new master on said print drum;

a printing section for feeding ink to said new master wrapped around said print drum to thereby print the document image on a sheet; and a control unit configured to control the printer such that while a master discharging operation of said master discharging section is under way, said master discharging operation is interrupted when said print drum reaches a stand-by position for awaiting said new master, and wherein after the leading edge of said new master has been clamped on said print drum during said master feeding operation, said master discharging operation is resumed during said master feeding operation and during a printing operation of said printing section.

18. A printer as claimed in claim 17, wherein said master discharging section is located in the vicinity of said master making section and upstream of said master making section in a direction of rotation of said print drum.

* * * * *